US005382052A

United States Patent [19]

Tarng

[11] Patent Number: 5,382,052

[45] Date of Patent: Jan. 17, 1995

[54] IN-LINE ROLLER BLADE FIGURE SKATE

[76] Inventor: Min M. Tarng, 1367 Glenmoor Way, San Jose, Calif. 95129

[21] Appl. No.: 900,136

[22] Filed: Jun. 18, 1992

Related U.S. Application Data

[63] Continuation-in-part of Ser. No. 662,717, Mar. 1, 1991, abandoned.

[51] Int. Cl.[6] ..... A63C 17/06

[52] U.S. Cl. ..... 280/844; 280/11.27; 305/52

[58] Field of Search ..... 280/11.115, 221, 87.042, 280/238, 252, 256, 257, 844, 11.19, 11.22, 11.27, 11.28; 192/64, 50, 43, 48.91; 305/60, 39, 52

[56] References Cited

U.S. PATENT DOCUMENTS

| | | | |
|---|---|---|---|
| 602,704 | 4/1898 | Kinsbruner | 280/11.115 |
| 1,652,284 | 12/1927 | Madsen | 280/252 |
| 1,694,162 | 12/1928 | Buitenkamp | 280/844 |
| 2,751,259 | 6/1956 | Bonmartini | 305/52 |
| 3,671,051 | 6/1972 | Werft | 280/844 |
| 3,695,736 | 10/1972 | Brown | 280/844 |
| 4,337,961 | 7/1982 | Covert et al. | 280/844 |
| 4,572,528 | 2/1986 | McBride | 280/844 |
| 4,627,630 | 12/1986 | Hütter | 280/844 |
| 4,915,403 | 4/1990 | Wild et al. | 280/221 |

FOREIGN PATENT DOCUMENTS

| | | | |
|---|---|---|---|
| 2651147 | 3/1991 | France | 280/844 |
| 954300 | 4/1964 | United Kingdom | 280/844 |

*Primary Examiner*—Richard M. Camby

[57] ABSTRACT

The in-line roller blade can skate forward, backward, sideward, turn right, turn left and spin to serve as a figure skate. The in-line roller blade figure skate and skateboard comprise a composite belt enwraping around the wheels. The composite belt comprises the resilient belt, string and beads. The self-propelling mechanism can rotate the wheel that the rider can skate without pushing against the ground. These two techniques can be applied to the ice skate to have the sideward skating capability.

22 Claims, 21 Drawing Sheets 50
9
2
10
72
5
11
70
71

5
72
11
70
71

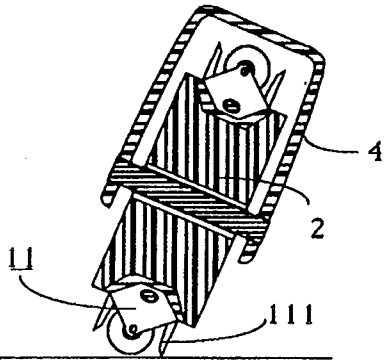
FIG.16
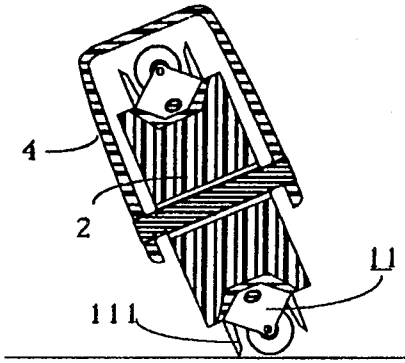
FIG.15
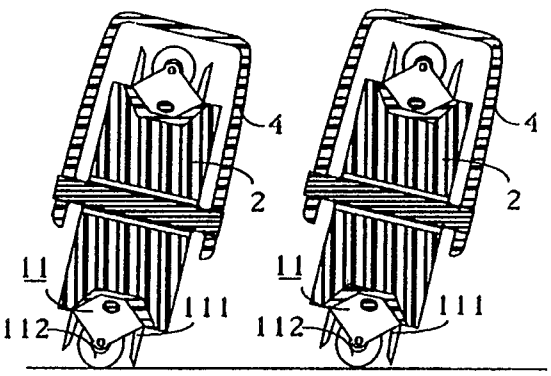
FIG.19B
FIG.19A
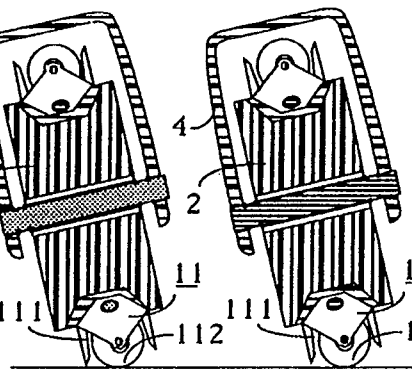
FIG.18B
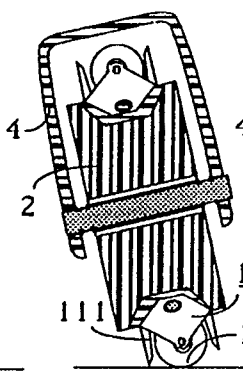
FIG.18A
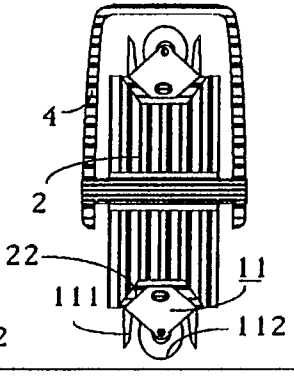
FIG.17B
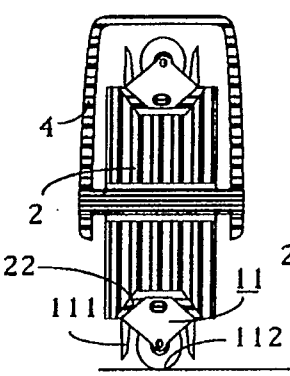
FIG.17A

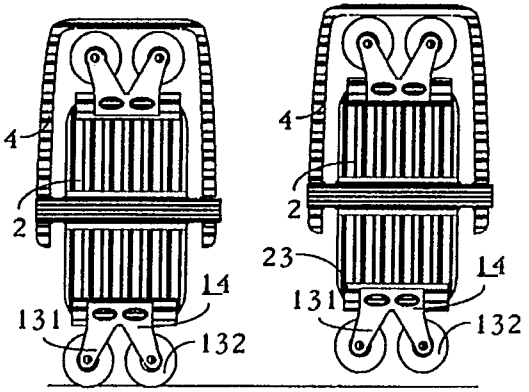
FIG.23A
FIG.23B
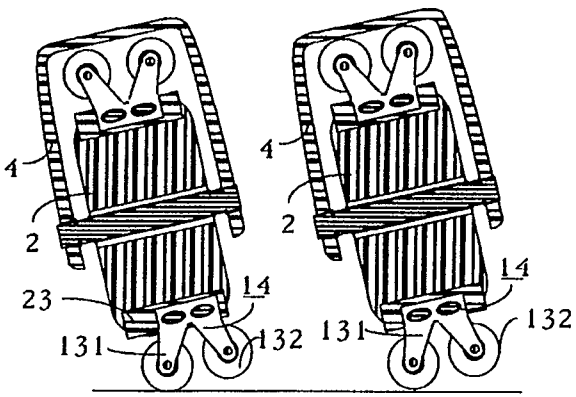
FIG.24A
FIG.24B
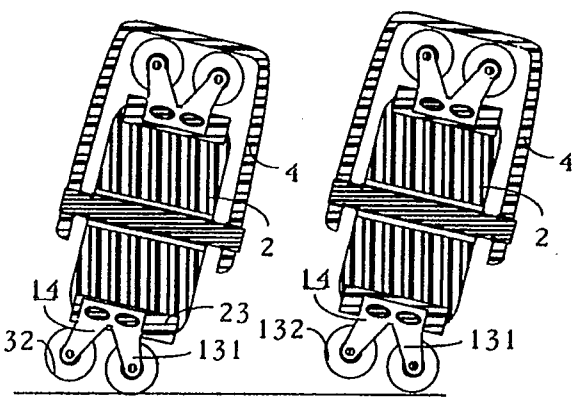
FIG.25A
FIG.25B

IN-LINE ROLLER BLADE FIGURE SKATE

This is a continue-in-part of Ser. No. 07/662,717, filed Mar. 1, 1991 now abandoned.

BACKGROUND-FIELD OF INVENTION

This invention is related to a curve-tracked in-line roller blade figure skate which can make single-foot turns, sideward slide and pivotal spin.

BACKGROUND-DESCRIPTION OF PRIOR ART

The in-line roller blade skate is the most popular roller skate today. There are three to five rollers lining up in one line. There are several strict restrictions for today's in line roller skate. Due to the speed requirement, the size of the roller cannot be too small. Due to the length of foot, the number of rollers cannot further increase. Five-roller is the upper limit. The contact area with the ground is limited to three to five points. As the road is uneven and rough, the contact area is even less. Thus the roller blade skating is not as smooth as ice skating. As the rigid roller hits on a little rock or small hole on the road, the jerk is very uncomfortable.

Even worse, the roller blade skate doesn't have the capability to make the single-foot right turn and left turn during the single-foot skating. So the in-line roller skate cannot serve as the figure skate. It makes the in-line roller blade skate only good for race and hockey. To meet the versatile requirements of figure skating, I invent the curved-tracked in-line roller blade figure skate. The in-line roller blade figure skate has the capability to turn right and left with smooth sliding and soft landing feeling. Furthermore, with the option of the bead, the in-line roller has the sideward skating capability. The self-propelling technology which had been disclosed in the application Ser. No. 07/662,717 is adopted that the in-line roller skate has the self-propelling and free-running capability. With this self-propelling and free-running capability, the skater can continuously skate with one foot only. Furthermore, I extend this technological innovation to the skateboard and ice skate design. It is the first time the ice skate has the sideward skate capability.

OBJECTS AND ADVANTAGES

Applying the technological breakthroughs in self-propelling and curved track to the in-line roller skate design, the in-line roller skate can skate forward, sideward, backward, spin and turn left and right with one single foot only.

DRAWING FIGURES

FIG. 7 is the side view of the self-propelling in-line roller skateboard; (A) shows a skateboard made of two skates; the front foot in the step-down position, the rear foot in the raise-up position; (B) is a skateboard with two in-line roller skates, the front foot in the raise-up position, the rear foot in the slop-down position; (C) shows two in-line roller skates aligned in-line; (D) shows two in-line roller skates aligned off-line.

Figure 8:
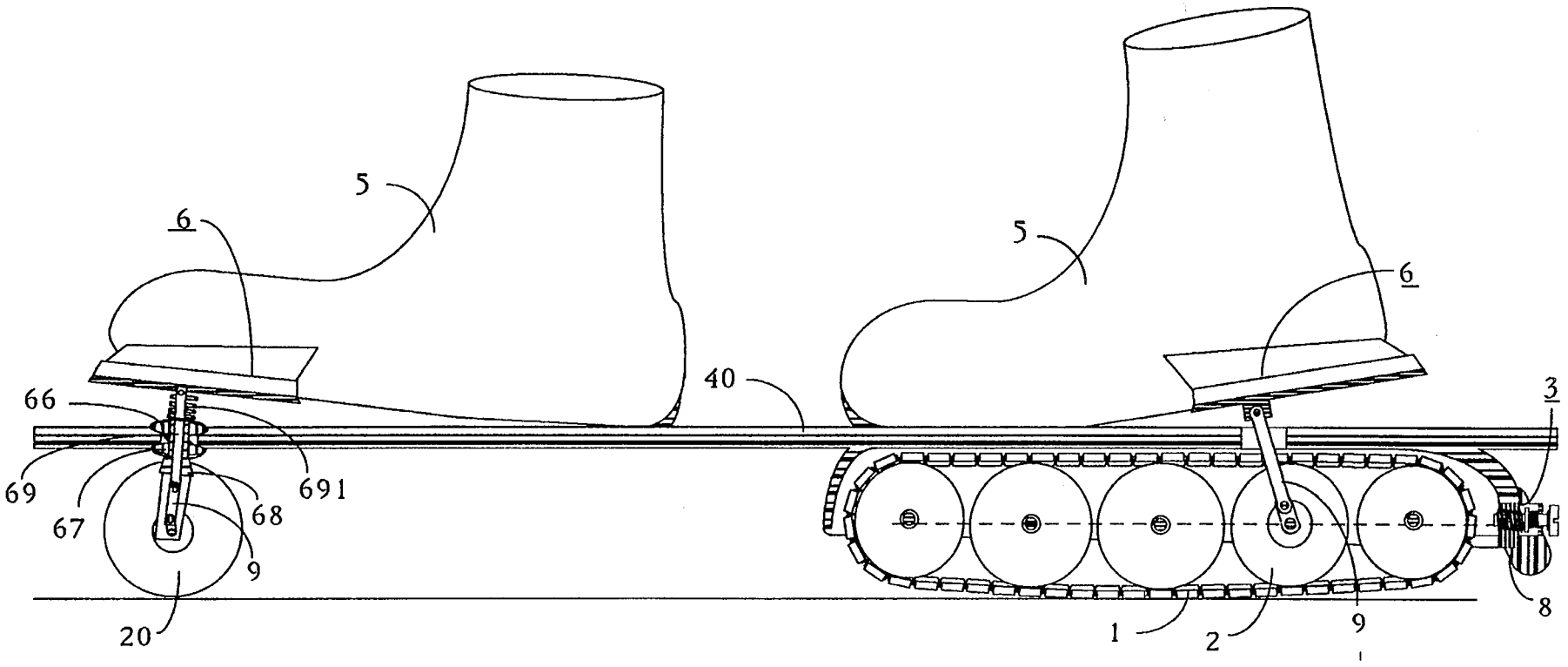

FIG. 8 is the side view of the self-propelling in-line roller skateboard with the pedal. The skateboard adopts the tri-cycle structure with the front wheel adopting the self-propelling mechanism.

Figure 9:
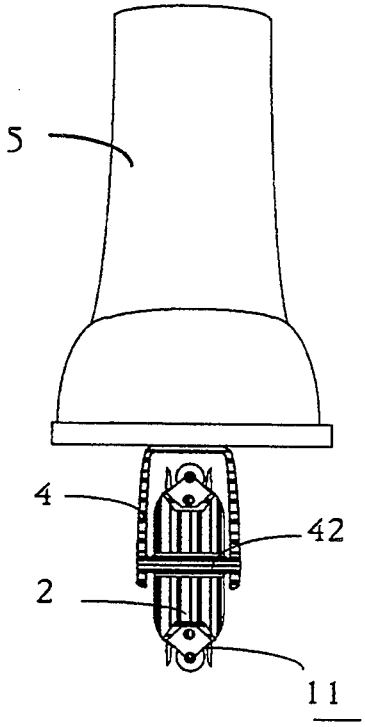

FIG. 9 is the partially exposed front view of in-line roller skate with the composite belt having the dual-knife-single-roller type of bead.

Figure 10:
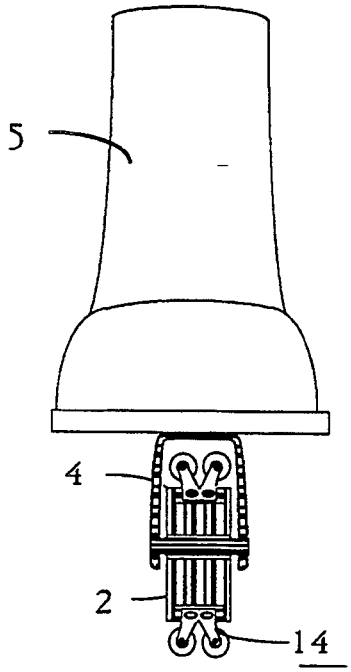

FIG. 10 is the partially exposed front view of the in-line roller skate with the composite belt having the dual-rollers type bead.

Figure 11:
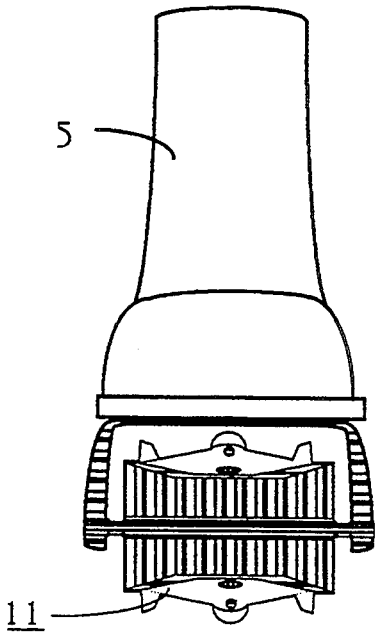

FIG. 11 is the partially exposed front view of the grass-ski which has the wider in-line wheel and composite belt.

Figure 12:
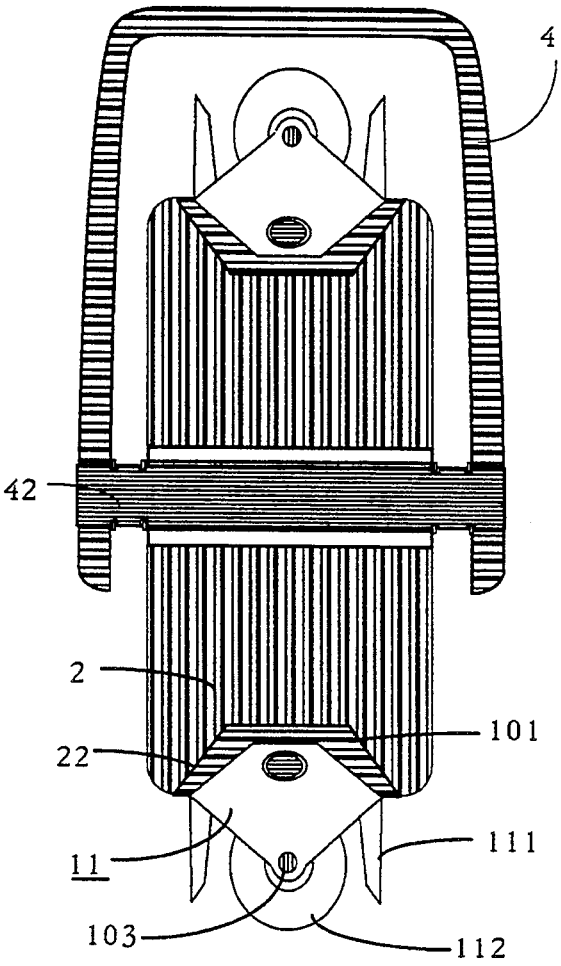

FIG. 12 is the detailed section view of the in-line roller skate with the composite belt having the dual-knife-single-roller type of bead.

Figure 13:
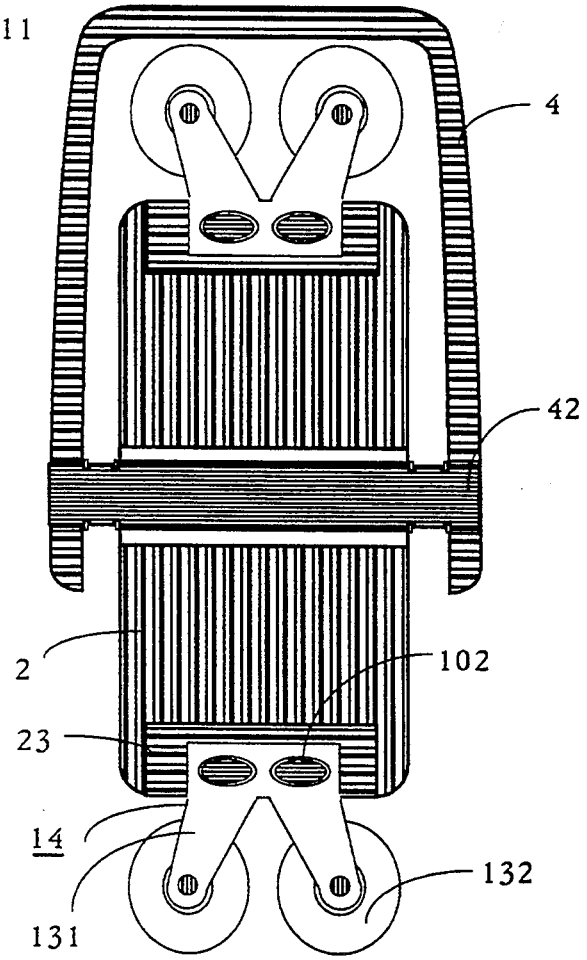

FIG. 13 is the detailed section view of the in-line roller with the composite belt having the dual-rollers type bead.

Figure 14:
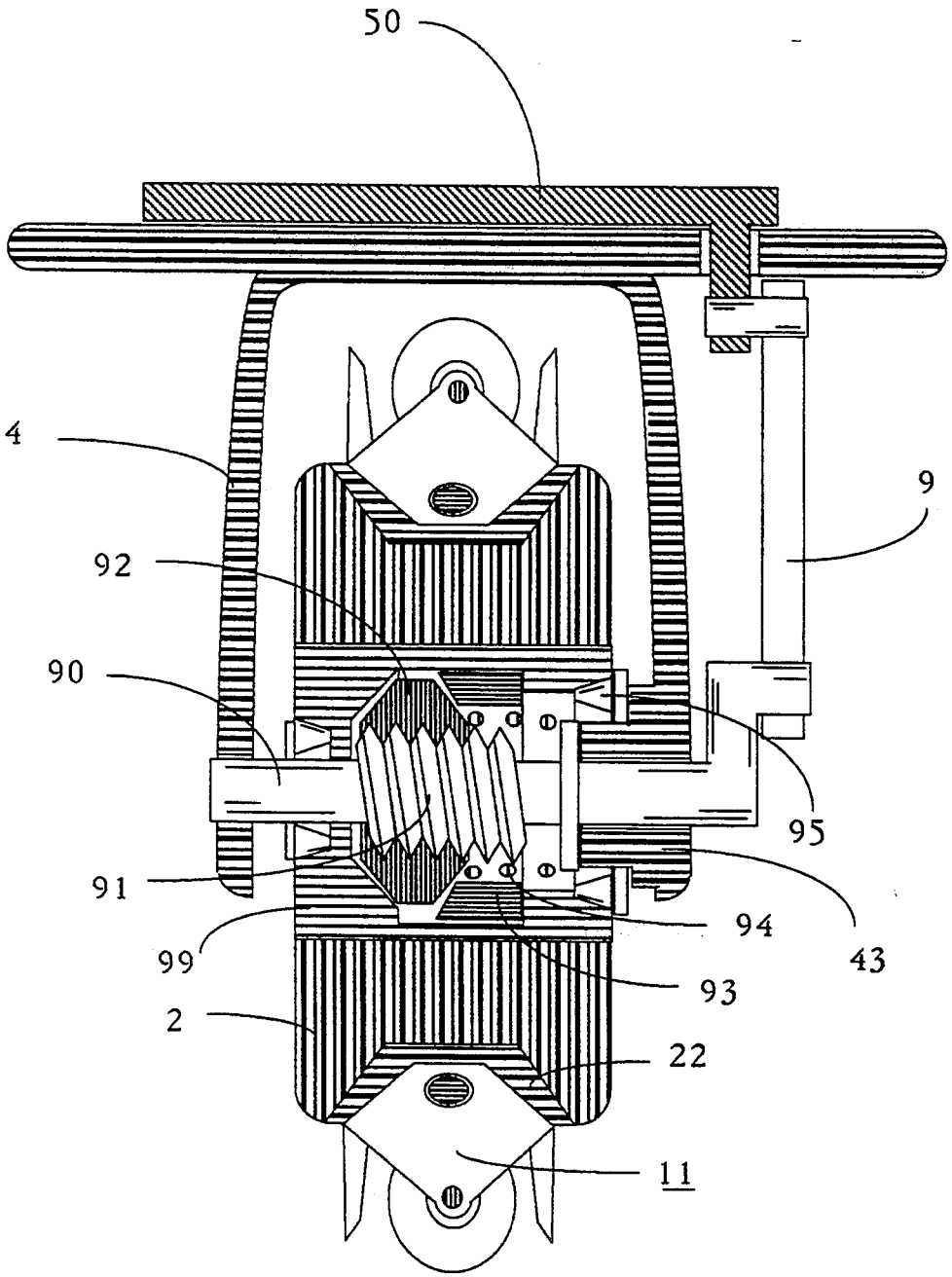

FIG. 14 is the detailed section view of the self-propelling in-line roller with the dual-knife-single-roller type of bead.

FIG. 15 is the side-kick position to push against the ground with the left knife of the bead.

FIG. 16 is the side-kick position to push against the ground with the right knife of the bead.

FIG. 17 shows the straight line skating position of the roller skate with the dual-knife-single-roller type of bead; (A) the bead beneath the middle wheel contacts with the ground: (B) the beads beneath the front wheel and rear wheel hang over the ground.

FIG. 18 shows the left turn skating position of the roller skate with bead having single roller and dual knives; (A) is the middle wheel with the bead being pushed rightward; (B) is the front wheel or the rear wheel with the bead staying in the middle of the wheel.

FIG. 19 shows the right turn skating position of the composite belt with single roller and dual knives; (A) is the middle wheel having the bead being pushed leftward; (B) is the front wheel or the rear wheel having the bead staying in the middle of the wheel.

Figure 20:
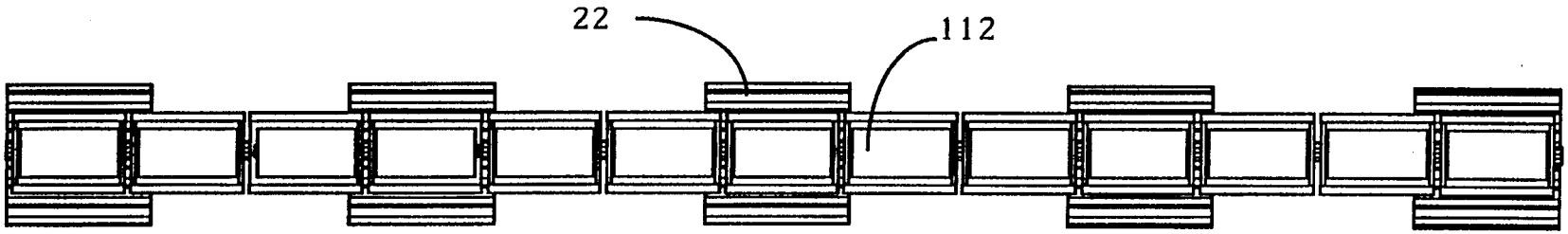

FIG. 20 shows the track of the beads in the straight line skating position corresponding to FIG. 17.

Figure 21:
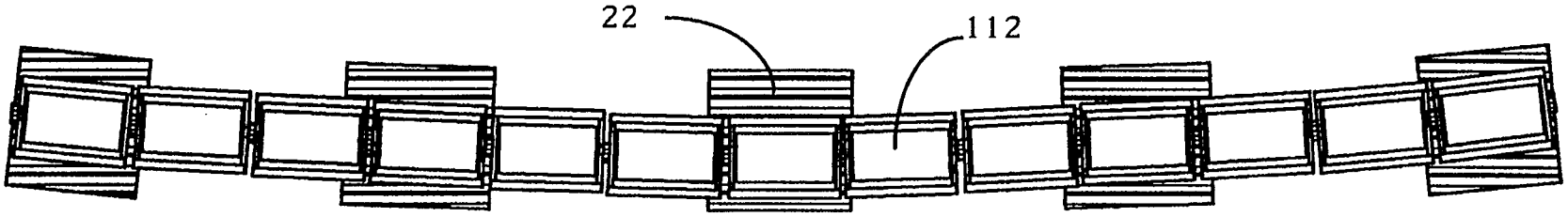

FIG. 21 shows the track of the beads in the left turn skating position corresponding to FIG. 18.

Figure 22:
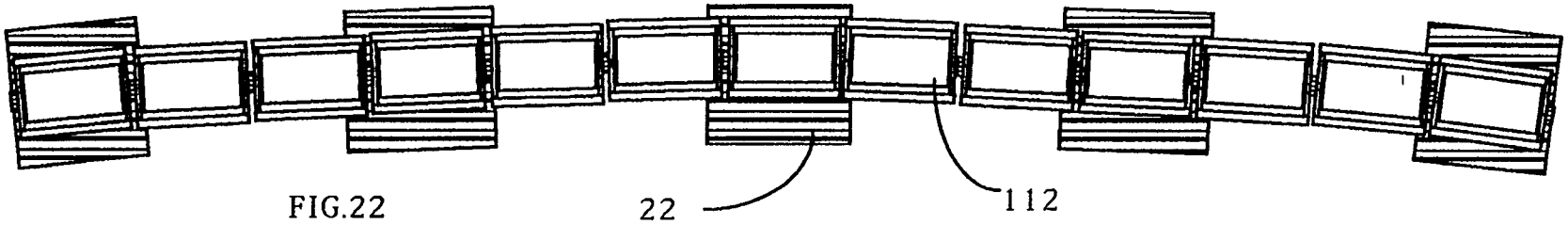

FIG. 22 shows the track of the beads in the right turn skating position corresponding to FIG. 19.

FIG. 23 shows the straight line skating position of the roller skate equipped with the bead of dual-rollers; (A)

the bead beneath the middle wheel contacts with the ground; (B) the bead beneath the front wheel and rear wheel hang over the ground.

FIG. 24 is the left turn skating position of the composite belt equipped with the bead having dual-rollers; (A) is the middle wheel with the bead being pushed rightward; (B) is the front wheel or the rear wheel with the bead staying in the middle of the wheel.

FIG. 25 is the right turn skating position of the roller skate equipped with the bead of dual-rollers; (A) is the middle wheel with the bead being pushed leftward; (B) is the front wheel or the rear wheel with the bead staying in the middle of the wheel.

Figure 26:
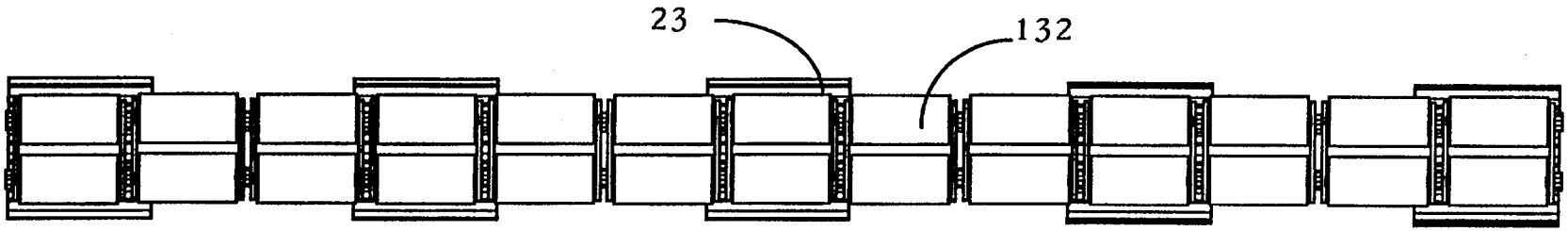

FIG. 26 is the track of the composite belt in the straight line skating position corresponding to FIG. 23.

Figure 27:
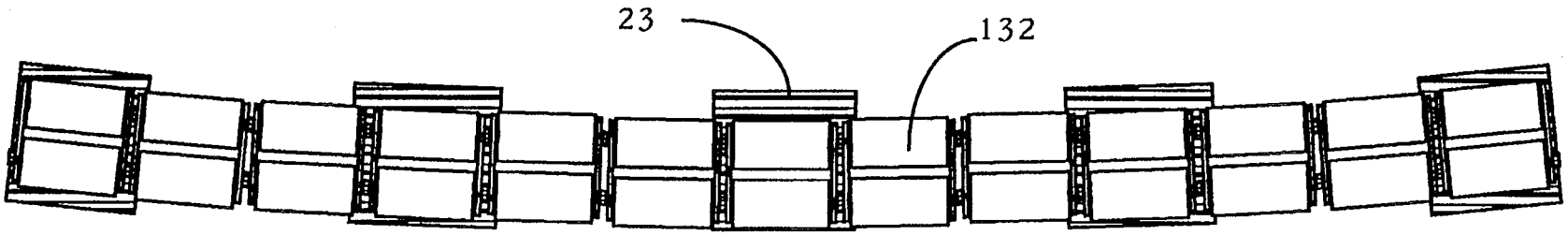

FIG. 27 is the track of the composite belt in the left turn skating position corresponding to FIG. 24.

Figure 28:
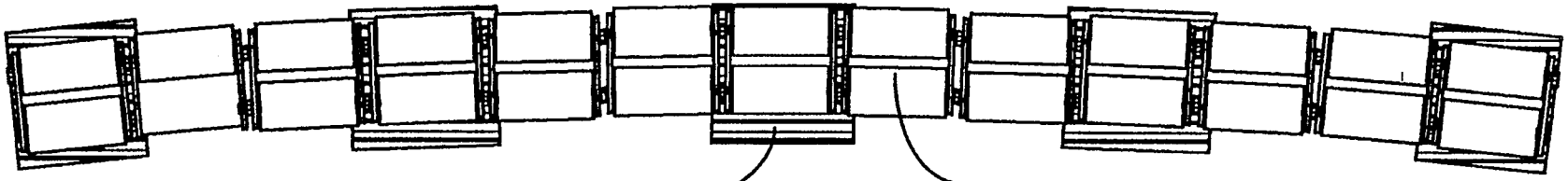

FIG. 28 is the track of the composite belt in the right turn skating position corresponding to FIG. 25.

Figure 3:
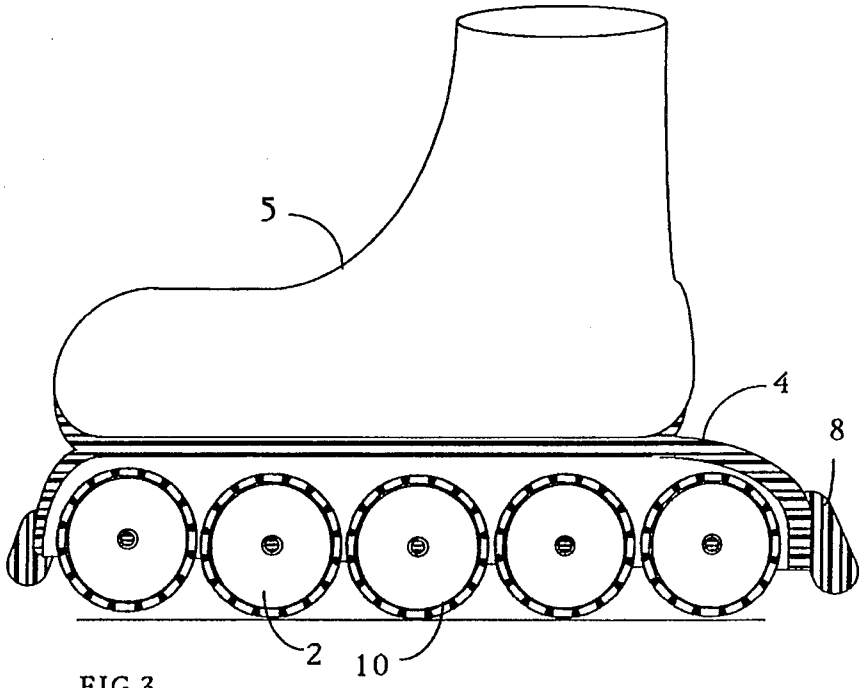
FIG. 3 is the partially exposed side view of the alternative design of the in-line roller skate having the flexible composite belt of the beads; the flexible composite belt of the beads enwraps around each wheel individually.
Figure 4:
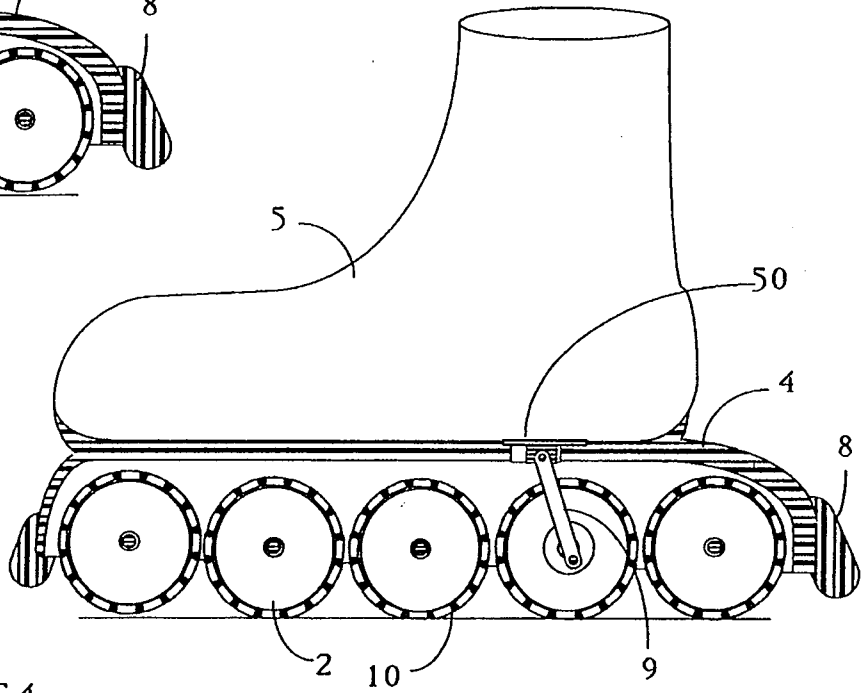
FIG. 4 is the partially exposed side view of the alternative design of the in-line roller skate having the flexible composite belt of the beads; the self-propelling in-line roller having the flexible composite belt of the beads enwrapping around each wheel individually.

FIG. 29 is the bead having single roller and dual-knives; (A) is the side-view of the bead of the track type; (B) is the front view of the bead; (C) is the side view of the bead of wheel type as shown in FIG. 3 and FIG. 4.

FIG. 30 is the alternative design of the bead having single roller and dual knives; (A) is the side-view of the bead of track type; (B) is the front view of the bead; (C) is the side view of the bead of wheel type as shown in FIG. 3 and FIG. 4.

FIG. 31 is the bead having dual-rollers; (A) is the side-view of the bead of track type; (B) is the front view of the bead; (C) is the side view of the bead of wheel type as shown in FIG. 3 and FIG. 4.

FIG. 32 is the alternative design of the bead having dual rollers; (A) is the side-view of the bead of track type; (B) is the front view of the bead; (C) is the side view of the bead of wheel type as shown in FIG. 3 and FIG. 4.

Figure 33A:
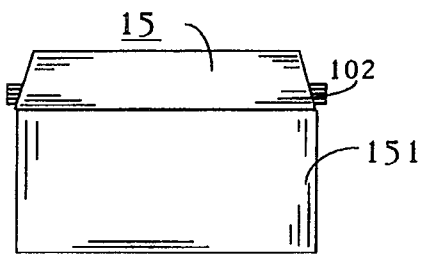
Figure 33B:
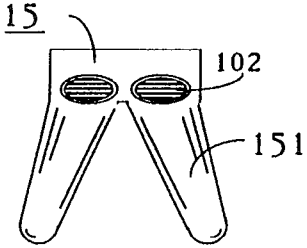

FIG. 33 is the bead having dual knives; (A) is the side-view of the bead of track type; (B) is the front view of the bead: (C) is the side view of the bead of wheel type as shown in FIG. 3 and FIG. 4.

FIG. 34 is the bead having knife-roller pair; (A) is the side-view of the bead of track type; (B) is the front view of the bead; (C) is the side view of the bead of wheel type as shown in FIG. 3 and FIG. 4.

FIG. 35 is the composite belt with constant tension mechanism to keep the composite belt under the constant stress; (A) is the belt being adjusted to the tight position; (B) is the belt being adjusted to the loose position.

Figure 36:
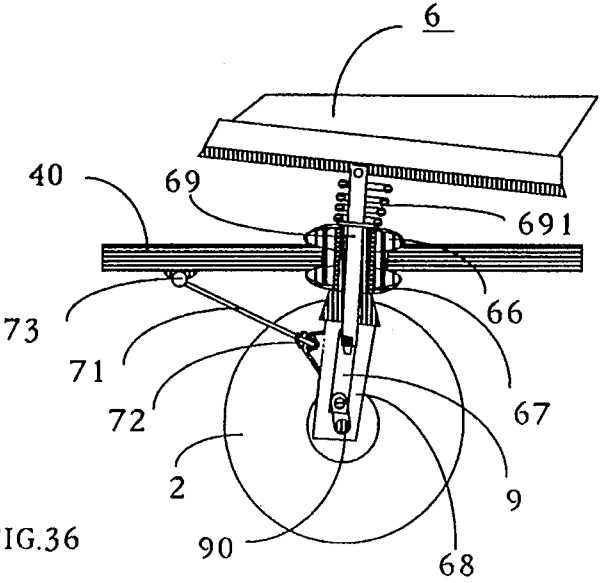

FIG. 36 is the partially exposed side view of the self-propelling wheels.

Figure 37:
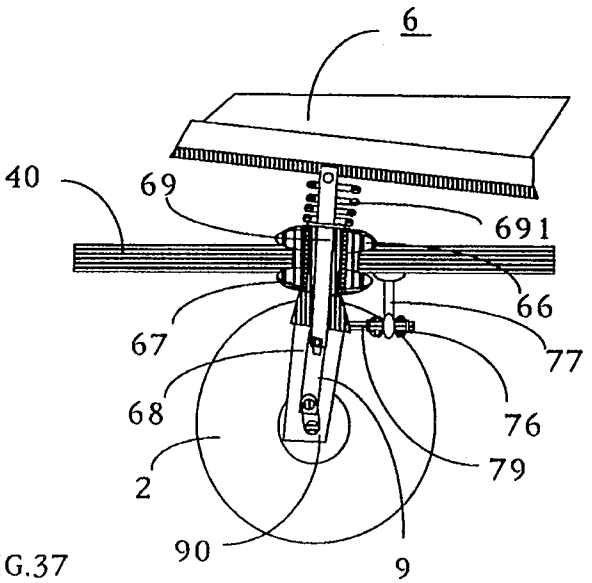

FIG. 37 is the alternative design of the partially exposed side view of the self-propelling wheels.

Figure 38:
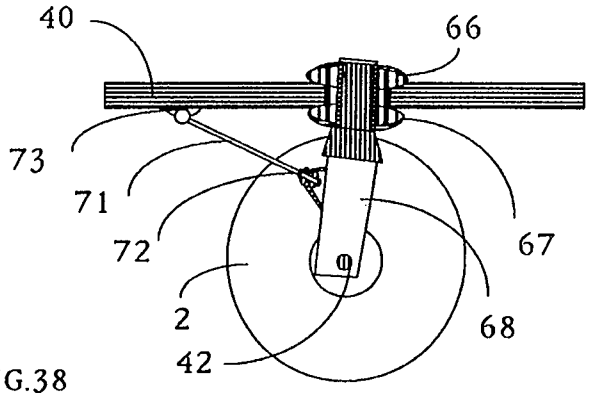

FIG. 38 is the steering wheels which can steer the board with the tilting of the board.

Figure 39:
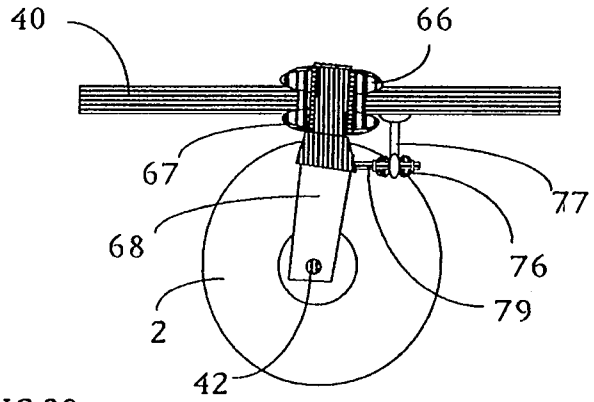

FIG. 39 is the alternative design of the steering wheels which can steer the board with the tilting of the board.

Figure 40:
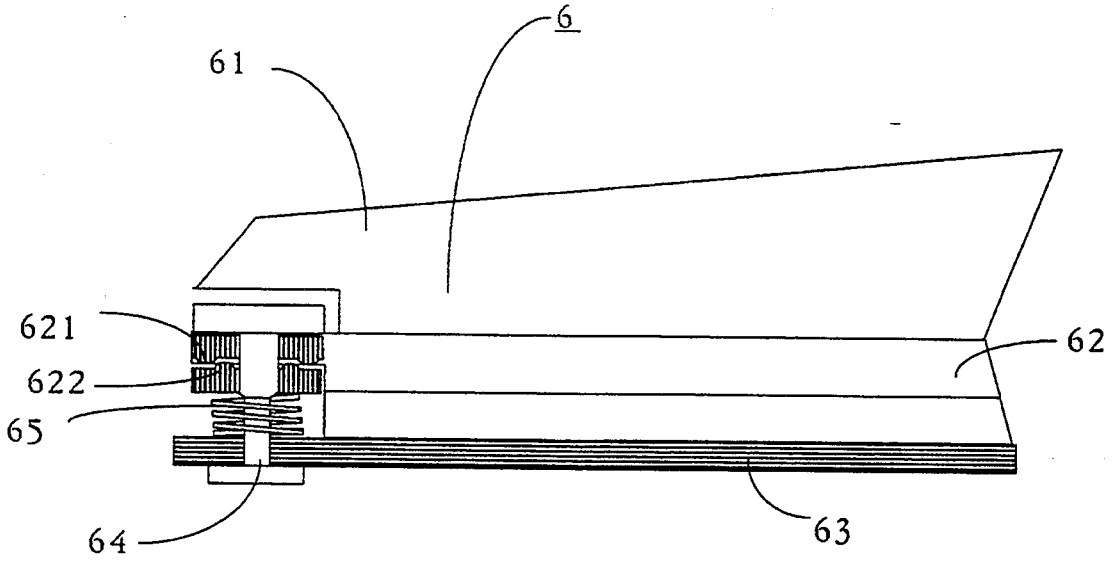

FIG. 40 is the partially exposed side view of the pedal.

Figure 41:
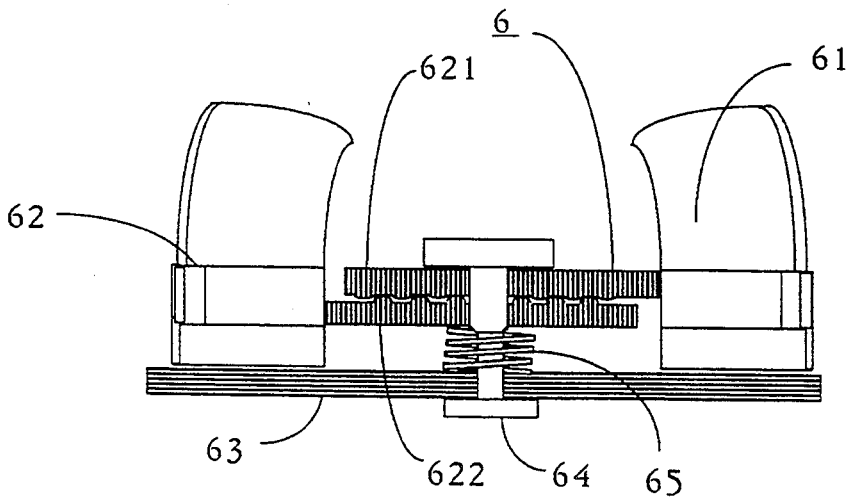

FIG. 41 is the partially exposed front view of the pedal as shown in FIG. 8.

FIG. 42 shows the operation of the pedal in FIG. 8; (A) shows the lock position; (B) shows the release position.

DESCRIPTION

In my invention, I have made two fundamental breakthroughs in the skate and skateboard. With the versatile combinations of the fundamental breakthoughs, a product line of skates and skateboards are invented. The composite belt 1 has three functions: (1) shock absorber; (2) distortion in the vertical direction: the beads have more contact with the ground as shown in FIG. 1; (3) lateral distortion in the right turn and left turn: the composite belt 1 forms the curved track as shown in FIG. 21 and FIG. 22.

Figures 1A, 1B:
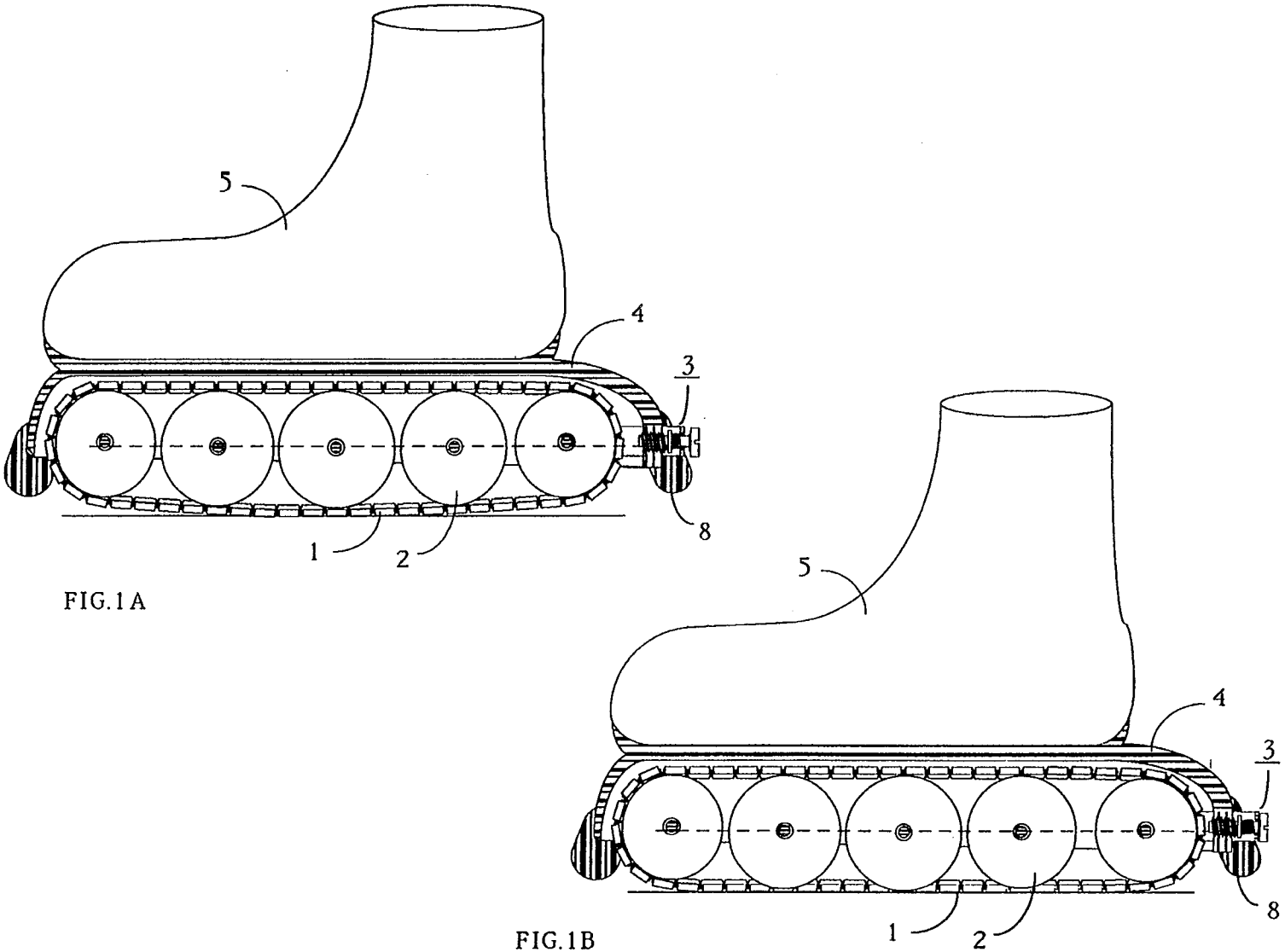
FIG. 1 is the partially exposed side view of the in-line roller skate having the flexible composite belt of the beads; (A) is the composite belt position without the application of body weight; (B) is the composite belt position with the application of body weight.

FIG. 1 is the basic version of the in-line roller figure skate equipped with the composite belt 1 made of resilient belt, string and beads. The composite belt 1 enwraps around the wheels 2. The wheels 2 are mounted on the frame 4. The brakes 8 are mounted at two ends of the frame 4. The constant tension mechanism 3 pulls the end wheel 2 at the end to keep the constant stress in the composite belt 1. The boot 5 can be manufactured to be one unit with the frame 4. The composite belt 1 is composed of the rigid beads and resilient belt. In FIG. 1A, the rider doesn't put the body weight on the wheel 2. Without the load of the rider's body weight, only the bead beneath the middle wheel 2 contacts with the ground. For the beads beneath the other wheels, there is a clearance between the gound and all the other beads. To have this effect, with the same radius of wheels, the axles are aligned with different heights; or the wheels may have different radiuses. In FIG. 1B, the rider puts the body weight on the wheels 2. The resilient belt is deformed that all the beads beneath wheels 2 contact with the ground. During the process, the length of composite belt 1 varies. The constant tension mechanism pulls the end wheels to keep the constant tension in the composite belt 1 that the composite belt 1 can enwrap around the wheels 2 properly.

Figures 2A, 2B:
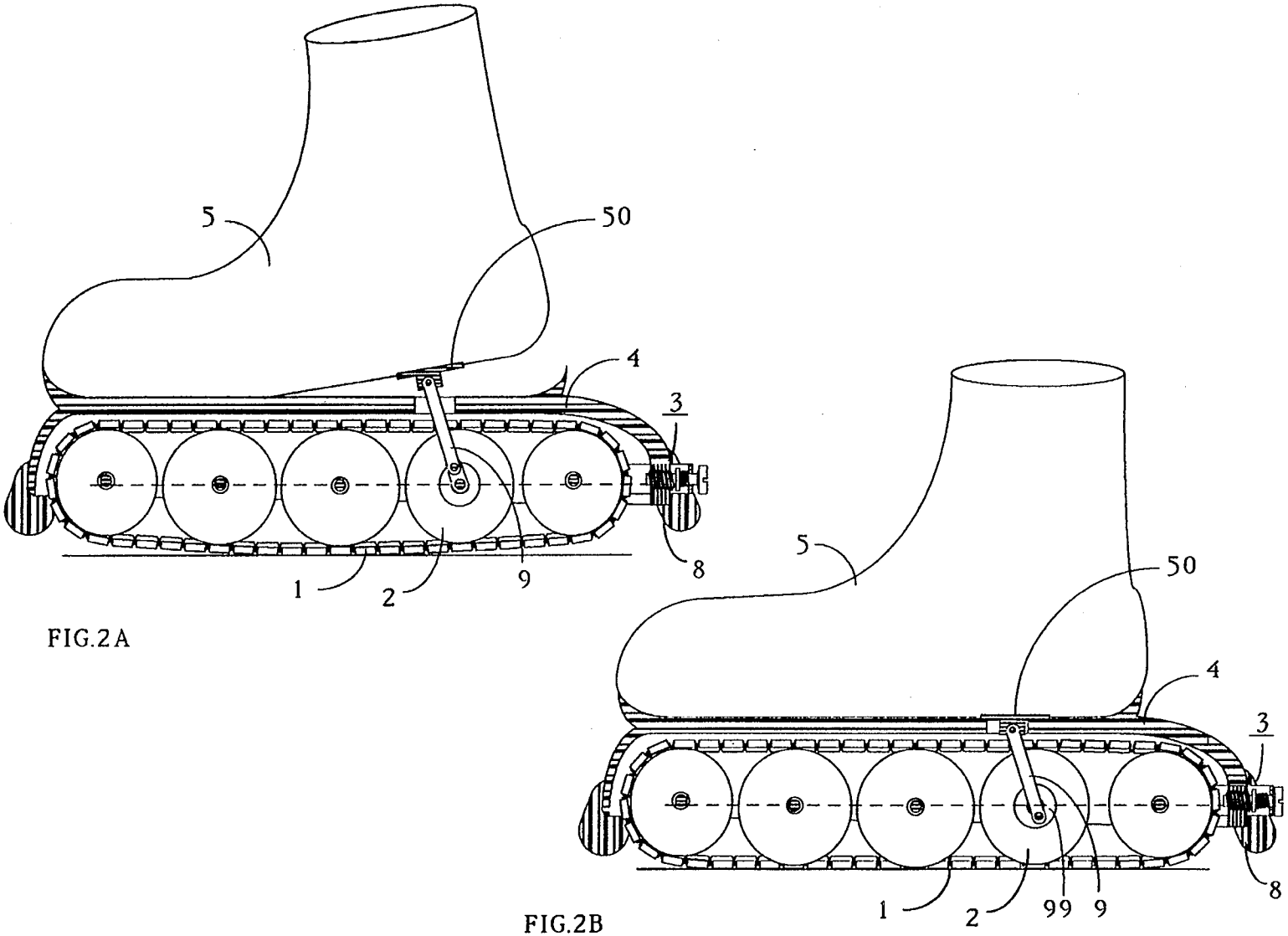
FIG. 2 is the partially exposed side view of the in-line roller skate with the flexible composite belt of the beads having the self-propelling capability; (A) is the raise-up position of the heel; (B) is the step-down position of the heel.

FIG. 2 is the self-propelling in-line roller skate. The rider does not need to push against the ground to skate forward. As shown in FIG. 2A and FIG. 2B, tapping on the pedal 50 with the heel, the cranking link 9 drives the axle to rotate the wheel 2. As the wheel 2 rotates, the composite belt 1 is pulled to skate forward or backward. As disclosed in the previous application Ser. No. 07/662,717, the skate can skate freely or brake to stop.

FIG. 3 is the alternative design of the in-line roller skate with the composite belt enwrapping around each wheel 2 individually. Without the application of body weight, the front wheel and the rear wheel have a small clearance the wheel and the ground. With the application of body weight, all the front wheel, middle wheel and rear wheel contact with the ground. FIG. 4 is the self-propelling in-line roller skate. The link 9 rotates the crankshaft to drive the wheel 2. The rotating wheel 2 drives the skate to skate forward or backward.

Figures 5, 6:
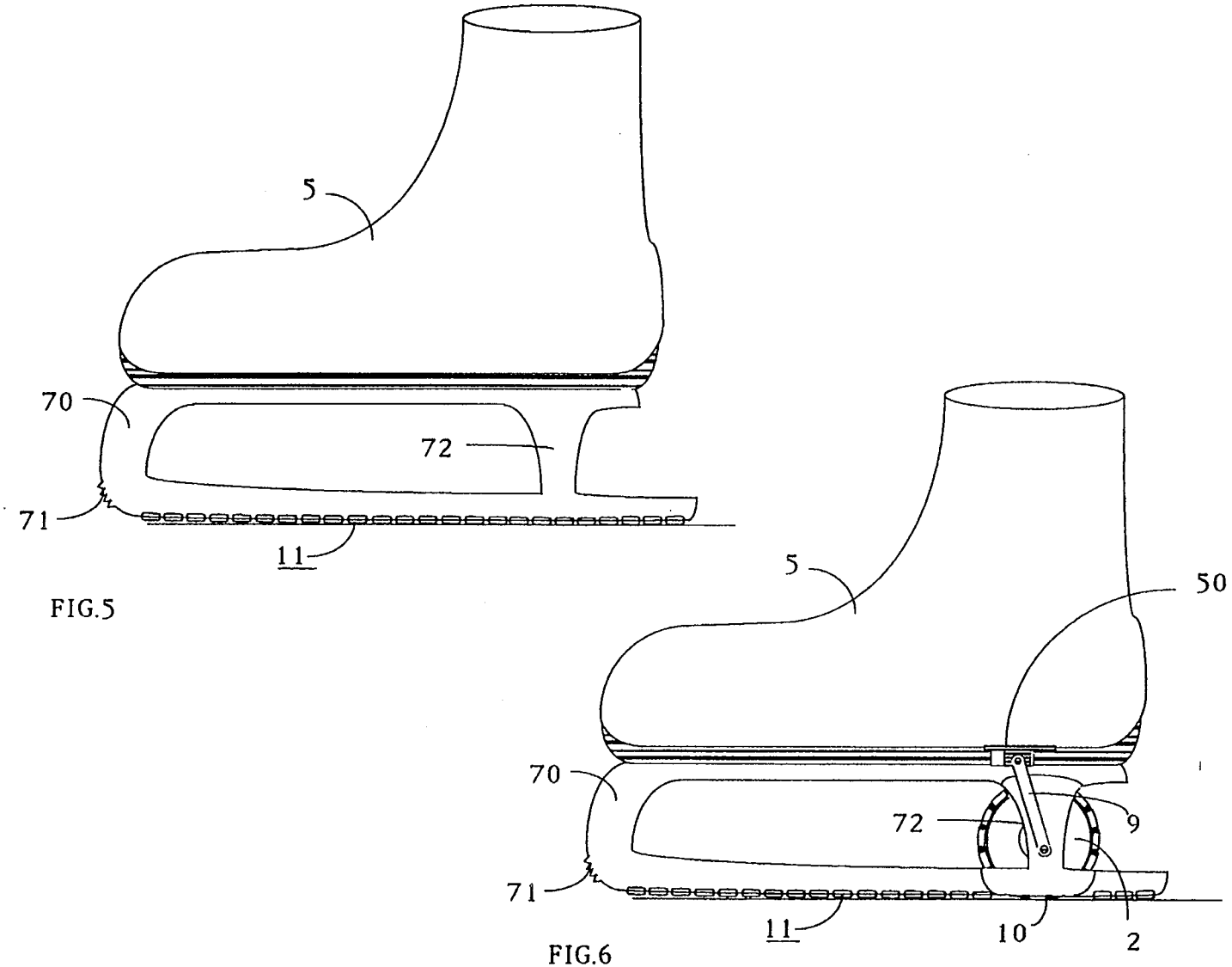
FIG. 5 is the side view of the ice skate having the sideward skating capability; the beads are aligned between the right and left knives.
FIG. 6 is the self-propelling ice skate having the sideward skating capability; the beads are aligned between the right and left knives.

The innovation of bead can be applied to the ice skate. In FIG. 5, the beads 11 are installed between the knives of the ice skate. The brake 71 is at the front portion of the frame 70. In FIG. 6, the self-propelling mechanism drives the ice skate to skate forward or backward. The wheel 2 is rotatably mounted on the frame 72.

Figure 7A:
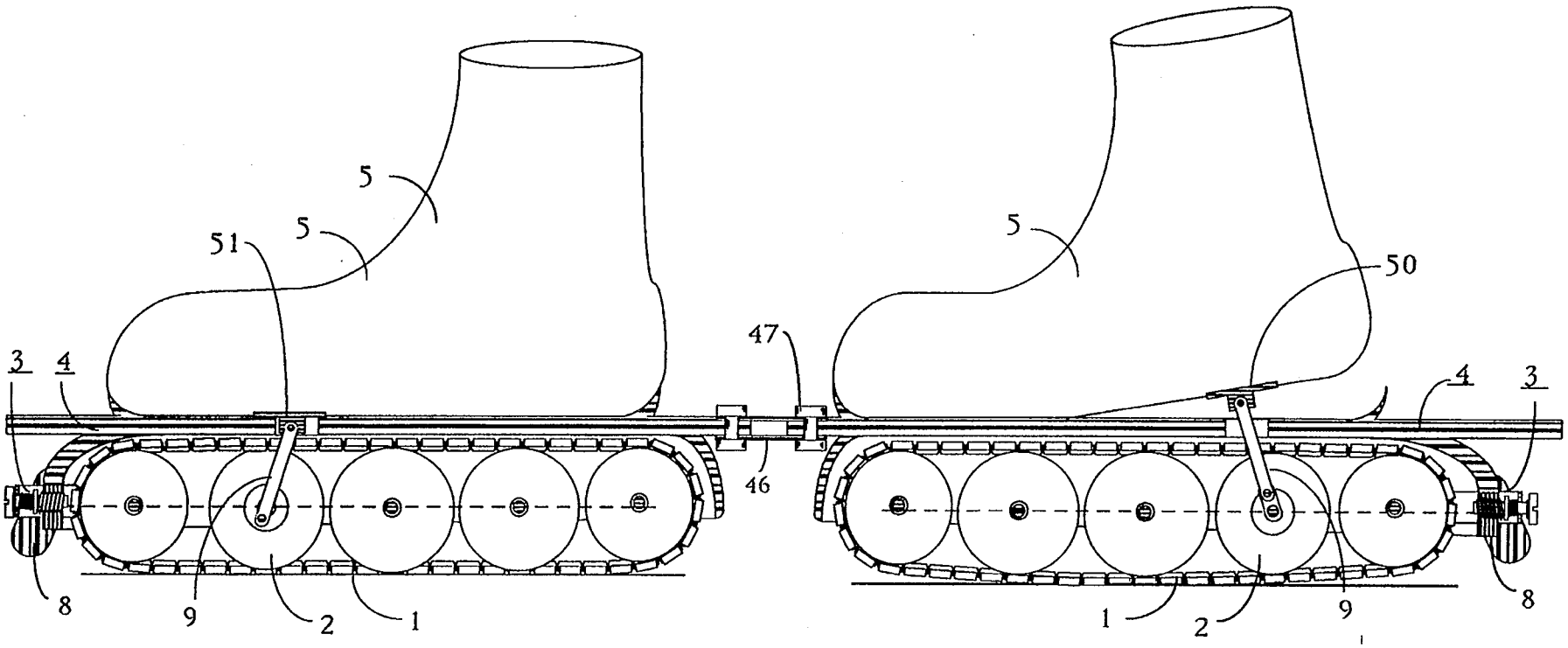
Figure 7B:
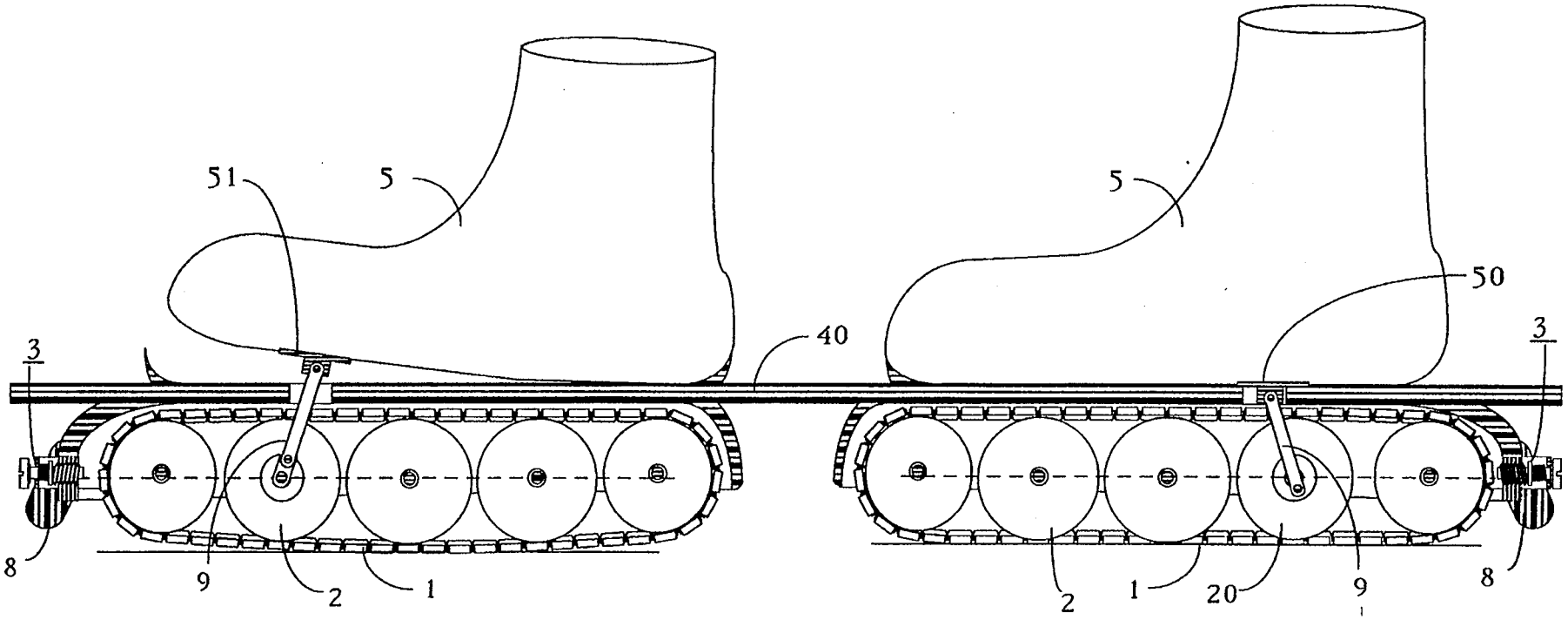
Figure 7C:
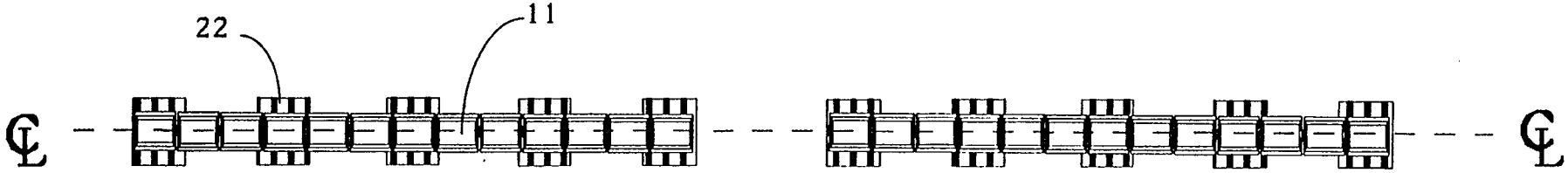
Figure 7D:
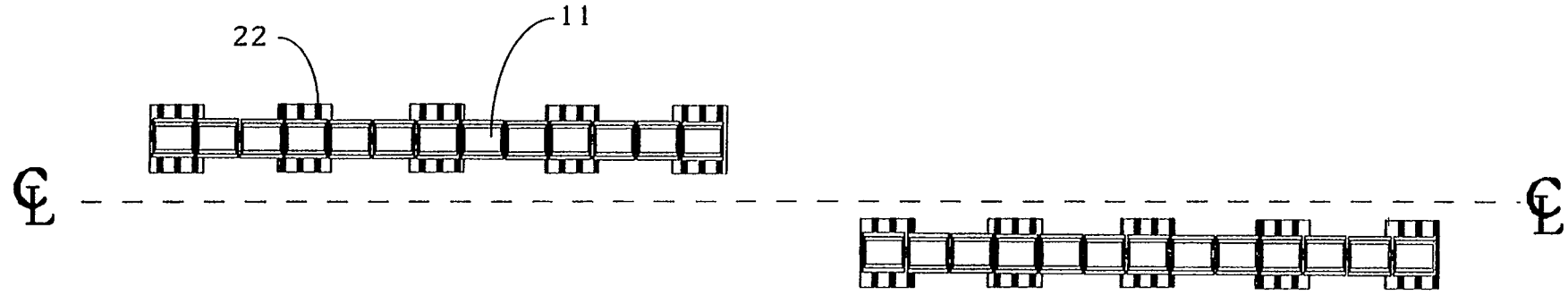

The self-propelling in-line roller skate can be applied to the skateboard. In FIG. 7A, it shows the combination of two skates to be one skateboard. In FIG. 7B, it shows an in-line roller skateboard 40. As shown in FIG. 7C, the two in-line roller skates are aligned in line. As shown in FIG. 7D, the two in-line roller skates are aligned off-line. There are adjusting screws 47 to adjust the in-line or the degree of off-line. If these two in-line rollers are in-line, the rider needs high balance skill. If these two in-line rollers are aligned off-line, the skateboard is stable to ride. For the combinatory skateboard, releasing the adjusting screws 47 and the extension board 46, the skateboard may be separated as two in-line skates. In FIG. 7A, the front pedal 51 is pressed down and the rear pedal 50 is raised up; in FIG. 7B, the front pedal 51 is raised up and the rear pedal 50 is pressed down. As shown in FIG. 7, the front pedal 51 and rear pedal are pressed down and raised up alternatively, the rotating wheels 2 drive the skateboard to skate forward or backward.

FIG. 8 shows the alternative design of the skateboard. The skateboard is similar to the tri-cycle. The front wheel design adopts the self-propelling mechanism which had been disclosed in the application of Ser. No. 07/662,717. The front pedal 6 holds the front portion of the front foot and the rear pedal 6 holds the heel of rear foot. To be safe to operate, the pedal is designed to have the automatic-lock-fast-release function. The resilient pad 66 pivotally holds the truck 68. The washer 67 holds the resilient pad 66 and distributes the reactive force uniformly over the resilient pad 66. The spring 691 is optional. The front pedal drives the link 69 to rotate the wheel 20; the rear pedal 60 drives the link 9 to rotate the wheel 2.

FIG. 9 is the partially exposed front view to show the alignment of the in-line roller skate with the composite belt 1. The composite belt 1 enwraps around the wheels 2. The wheels 2 are rotationally mounted on the frame 4 with the axle 42. The beads 11 are of the single-roller dual-knife type as shown in FIG. 29. In FIG. 10, the in-line roller skate has the composite belt 1 with the dual-roller type of bead as shown in FIG. 32. The composite belt 1 equipped with the single-roller dual-knife type of beard is suitable for the roller skate as shown in FIG. 1. The composite belt 1 equipped with the dual-roller type of bead is suitable for the self-propelling roller skate as shown in FIG. 2.

The in-line roller skate is not only for the road but also for the grass and snow. FIG. 11 shows the in-line roller skate type of grass ski. The wheels 2 and the composite belt 1 are much wider.

FIG. 12 and FIG. 13 show the detailed structure of the composite belt 1. The composite belt 1 is constituted of the string 101, the resilient belt 22 and the single-roller-dual-knife type of bead 11. The composite belt 1 enwraps around the wheel 2. The wheel 2 has the slot for the composite belt 1 to fit in. The wheel 2 is rotatably mounted on the axle 42. The bead 112 is rotatably mounted on the axle 103. The knife 111 is one unit with the frame of the bead 11. The top of the bead 11 and the resilient belt 22 are in the trapezoid shape. FIG. 13 shows the alternative design of the bead 14. The composite belt 1 is constituted of the string 102, the resilient belt 23 and the bead 14. The bead 14 is constituted of the fork 131 and the rollers 132.

FIG. 14 shows the detailed structure of the self-propelling wheel mechanism. The function of this mechanism had been disclosed in detail in the previous application Ser. No. 07/662,717. The link 9 makes the connection between the pedal 50 and the crankshaft 90. The screws 91 are knotched on the crankshaft 90. The engaging drum 92 is rotatably mounted on the crankshaft 91. The gripping spring 94 holds the drum 92 with small gripping force. As the crankshaft 90 rotates forward, the engaging drum 92 engages with the hub 99 by the wedge force in the left shift to drive the wheel 2 to skate forward. As the crankshaft 90 holds still, the forward rotation of wheel 2 will disengage the engagement between the hub 99 and the engaging drum 92. The wheel 2 is free to rotate. As the crankshaft 95 rotates backward, the engaging drum 92 engages with the wedge block 93 and the hub 99 by the wedge force in the right shift to drive the wheel 2 to skate backward. As the crankshaft 90 holds still, the backward rotation of wheel 2 will disengage the engagement among the engaging drum 92, the hub 99 and wedge block 93. The wheel 2 is free to rotate.

From FIG. 15 to FIG. 22, they show the different operations of the in-line roller skate equipped with the composite belt 1 having the beads of the single-roller dual-knife type.

In FIG. 15, the left knife 111 hits against the ground. This action can be used to push the rider to skate rightward or brake in the leftward skating. In FIG. 16, the right knife 111 hits against the ground. This action can be used to push the rider to skate leftward or brake in the rightward skating.

FIG. 17 shows the beads of composite belt 1 in the straight skate position. Without the load of body weight, in FIG. 17A, the bead 112 beneath the middle wheel 2 makes the full contact with the ground; in FIG. 17B, the front wheel 2 or the rear wheel 2 has a small clearance with the ground. With body weight, all the beads beneath the middle wheel, front wheel and rear wheel make contacts with the ground. However, the distortion of the resilient belt 22 under the middle roller is larger than the distortion of the resilient belt under the front wheel and rear wheel. The resilient belt 22 offers a smooth transition for the ground impact on the wheels. The straight-line track of the beads is shown in FIG. 20.

FIG. 18 shows the positions of the composite belt 2 during the in-line roller skate making a left turn. In FIG. 18A, the bead beneath the middle wheel 2 is pushed rightward. In FIG. 18B, the bead beneath the front wheel 2 or the rear wheel 2 still stays in the central position. FIG. 21 shows the corresponding track of the beads in the left turn. The track of the composite belt I forms a left turn curvature that the in-line roller skate can make the left turn.

FIG. 19 shows the positions of the composite belt 1 during the in-line roller skate making a right turn. In FIG. 19A, the bead beneath the middle wheel 2 is pushed leftward. In FIG. 19B, the bead beneath the front wheel 2 or the rear wheel 2 still stays in the central position. FIG. 22 shows the corresponding track of the composite belt 1 in the right turn. The track of the composite belt 1 forms a right turn curvature that the in-line roller skate can make the right turn.

From FIG. 23 to FIG. 28, they show the different operations of the in-line roller skate equipped with the composite belt 1 having beads of the dual-roller type. FIG. 23 shows the composite belt 1 in the straight skate position. Without the load of body weight, in FIG. 23A, the beads 132 beneath middle wheel 2 make the full contact with the ground; in FIG. 23B, the front wheel 2 or the rear wheel 2 has a small clearance with the ground. With the load of body weight, all the beads beneath middle wheel, front wheel and rear wheel make the contact with the ground. However, the distortion of the resilient belt 23 beneath the middle wheel is larger than the distortion of the resilient belt beneath the front wheel or the rear wheel 2. The resilient belt 23 offers a smooth transition for the ground impact on the wheels. The track of the composite belt 1 equipped with beads 132 is shown in FIG. 26.

FIG. 24 shows the positions of the composite belt 1 during the in-line roller skate making a left turn. In FIG. 24A, the beads beneath the middle wheel are pushed rightward. In FIG. 24B, the beads beneath the front wheel and the rear wheel still slay in the central position. FIG. 27 shows the corresponding track of the composite belt 1 in the left turn. The track of the composite belt 1 forms a left turn curvature that the in-line roller skate can make the left turn.

FIG. 25 shows the positions of the composite belt 1 during the in-line roller skate making a right turn. In FIG. 25A, the beads beneath the middle wheel are pushed leftward. In FIG. 25B, the beads beneath the front wheel and the rear wheel still stay in the central position. FIG. 28 shows the corresponding track of the composite belt 1 in the right turn. The track of the composite belt 1 forms a right turn curvature that the in-line roller skate can make the right turn.

The beads have many different designs. From FIG. 29 to FIG. 34, they show the different alternative designs of the beads. The rider may change the composite belt 1 of the beads to meet the different road conditions.

Figure 29C:
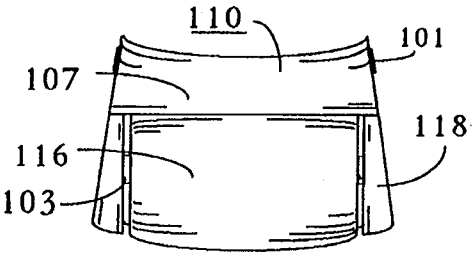
Figure 29B:
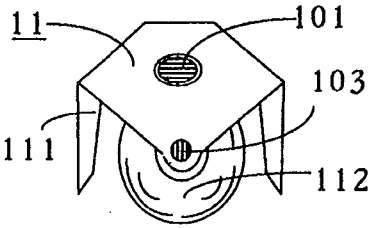
Figure 29A:
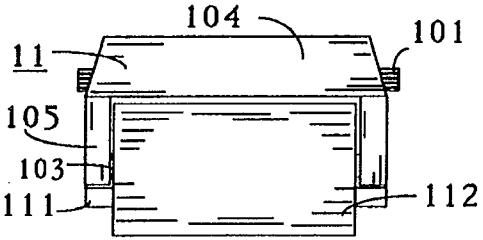

FIG. 29 is the bead 11 of the single-roller-dual-knife type. The top 104 and the resilient belt 22 are in the trapezoidal shape. The string 101 hooks the beads 11 to be a chain. The roller 112 is rotatably mounted on the axle 103. The frame 105 is one unit with the top 104. In FIG. 29A, the bead 11 is for the composite belt 1 of track type as shown in FIG. 1. In FIG. 29C, the bead 110 is for the composite belt 10 of the wheel type as shown in FIG. 3. FIG. 29B is the front view of the bead 11 or 110. In FIG. 29C, the top 107 of bead 110 has a curvature. The roller 116 has the shape of a round drum. The roller 116 is rotatably mounted on the bracket 118. The bracket 118 has the shape of a fan.

Figure 30C:
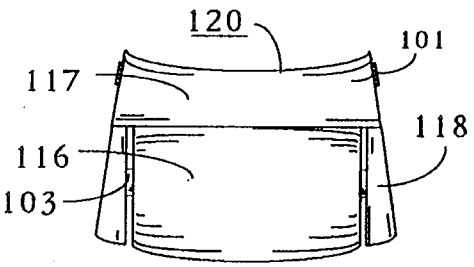
Figure 30B:
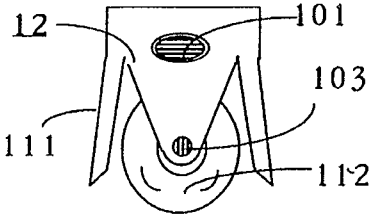
Figure 30A:
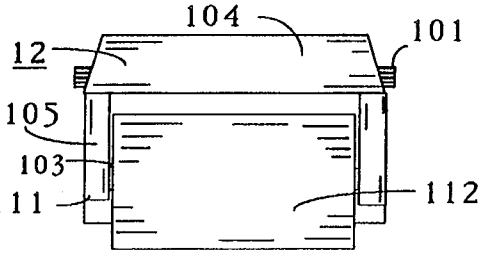

FIG. 30 is the bead 12 having the single roller and the dual-knives. The top and the resilient belt 23 are in the rectangular shape. In FIG. 30A, the bead 12 is for the composite belt of track type 1 as shown in FIG. 1. In FIG. 30C, the bead 120 is for the composite belt 10 of the wheel type as shown in FIG. 3. FIG. 30B is the front view of the bead 12 or 120. The top 117 of bead 120 has a curvature.

Figure 31C:
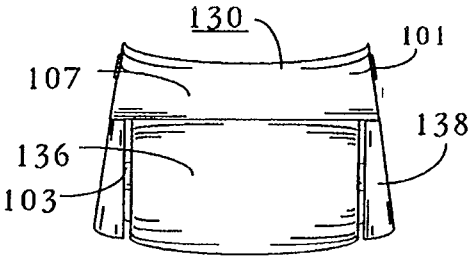
Figure 31B:
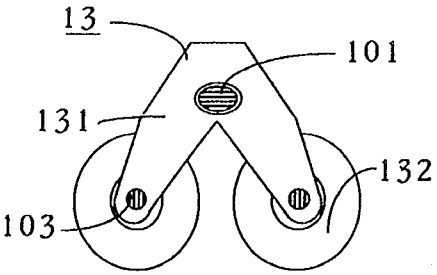
Figure 31A:
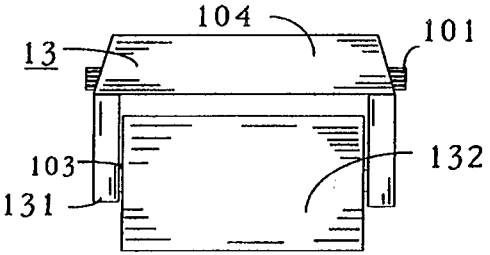

FIG. 31 is the bead 13 having the dual-rollers. The top 104 and resilient belt 22 are in the trapezoidal shape. The roller 132 is rotatably mounted on the axle 103. The fork 131 is one unit with the top 104. In FIG. 31A, the bead 13 is for the composite belt of track type 1 as shown in FIG. 1. In FIG. 31C, the bead 130 is for the composite belt 10 of the wheel type as shown in FIG. 3. FIG. 31B is the front view of the bead 13 or 130. The top 107 of bead 130 has a curvature. The roller 136 has the shape of a round drum. The roller 136 is rotatably mounted on the bracket 138. The bracket 138 has the shape of a fan.

Figure 32A:
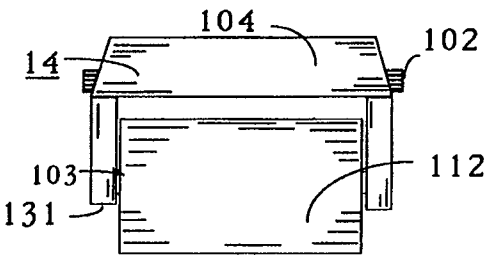
Figure 32B:
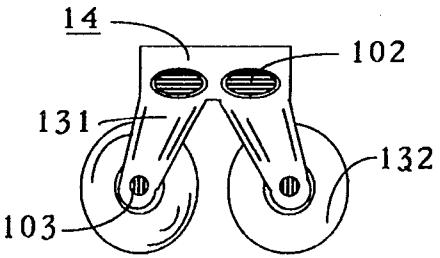
Figure 32C:
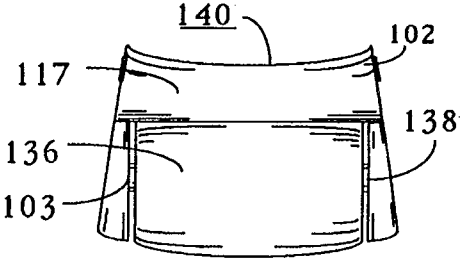

FIG. 32 is the bead 14 having the dual rollers. The string 102 hooks the beads 14 to be a chain. The top and the resilient belt are in the rectangular shape. In FIG. 32A, the bead 14 is for the composite belt of track type as shown in FIG. 1. In FIG. 32C, the bead 140 is for the composite belt 10 of the wheel type as shown in FIG. 3. FIG. 32B is the front view of the bead 14 or 140. The top 117 of bead 120 has a curvature.

Figure 33C:
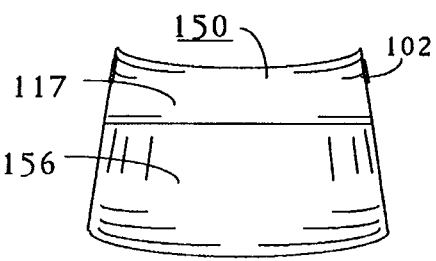

FIG. 33 is the bead 15 having the dual-knives. The top 117 and the resilient belt 23 are in the rectangular shape. The string 102 hooks the beads 15 to be a chain. The fork 151 is of one unit with the top. In FIG. 33A, the bead 15 is for the composite belt 1 of track type 1 as shown in FIG. 1. In FIG. 33C, the bead 150 is for the composite belt 10 of the wheel type as shown in FIG. 3. FIG. 33 B is the front view of the bead 15 or 150. The top 117 and the bottom of fork 156 of bead 150 have curvatures.

Figure 34A:
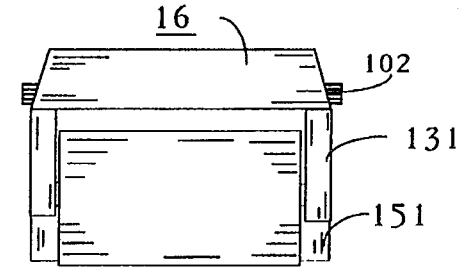
Figure 34B:
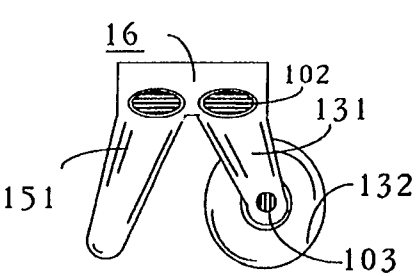
Figure 34C:
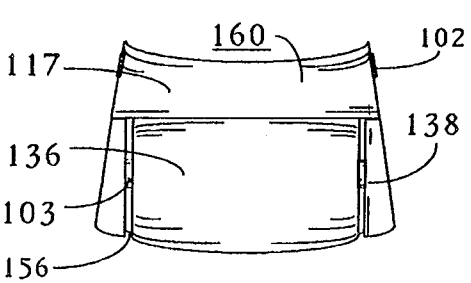

FIG. 34 is the bead 16 of single-roller-single-knife type. The top and the resilient belt are in the rectangular shape. The string 102 hooks the beads 16 to be a chain. The forks 151 and 131 are of one unit with the top. The bead 132 is rotationally mounted on the axle 103. In FIG. 34A, the bead 16 is for the composite belt 1 of track type as shown in FIG. 1. In FIG. 34C, the bead 156 is for the composite belt 10 of the wheel type as shown in FIG. 3. FIG. 34B is the front view of the bead 16 or 160. The top 117 and the bottom of fork 156 of bead 160 have a curvature. The bead 136 has the shape of round drum. The bead 136 is rotatably mounted on the axle 103. The side views of the bracket 138 and knife 156 have the shape of a fan.

Figure 35A:
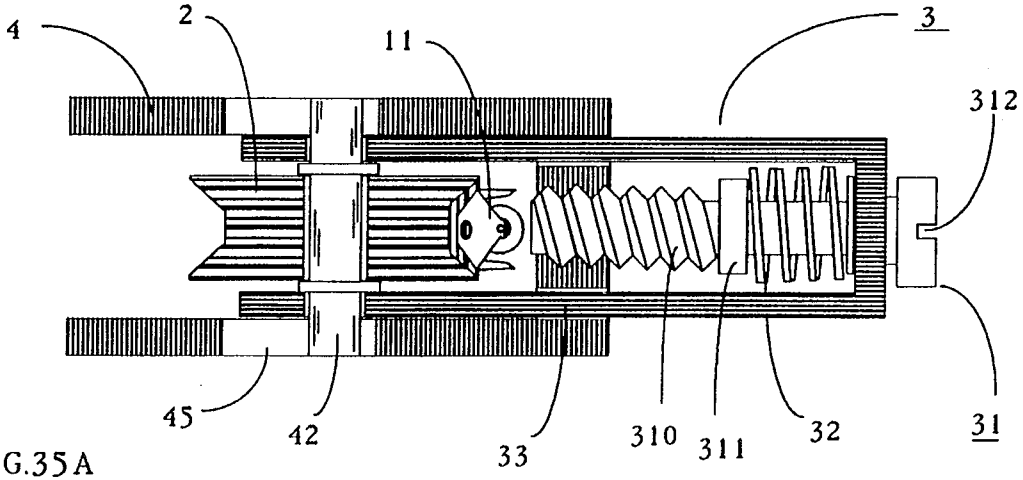
Figure 35B:
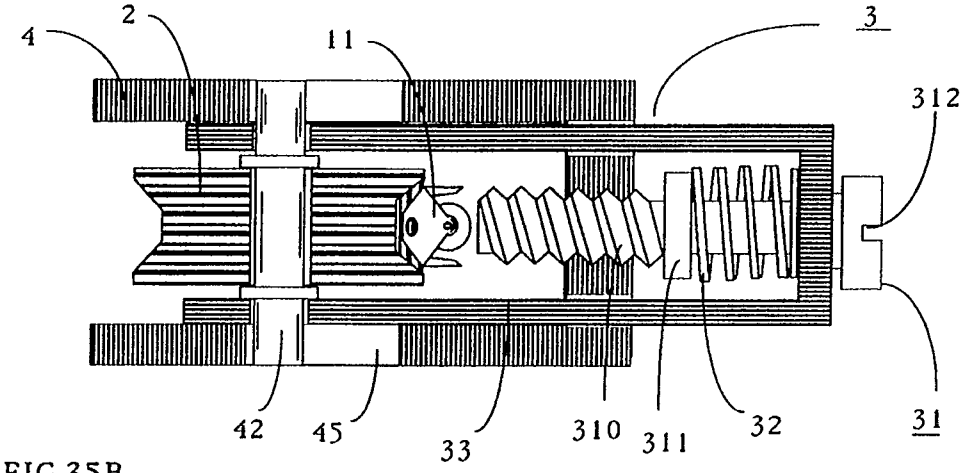

During the turning direction, not only the curvature of the track but also the length of the track vary. To adjust the variance of the length of the composite belt 1 and keep the stress in the composite belt 1 to be constant, the constant tension mechanism 3 is installed at the end of the frame 4. FIG. 35 is the top section view of the constant tension mechanism 3. The constant tension mechanism comprises the bracket of sliding guide 33, the adjust screw 31 and the biasing spring 32. The adjusting screw comprises the head 312, the screw 310 and the ring of the bias shoulder 311. By adjusting the adjust screw 31, the bracket 33 shifts to pull the axle 42 of the wheel 2 to move the position. One end of the spring 32 biases against the shoulder ring 311. The other end of the spring 32 biases against the bracket 33 to keep the constant stress in the composite belt 1. FIG. 35A and FIG. 35B show the adjustment of the screw to vary the position of the end wheel 2. The wheel 2 pulls the composite belt 1 to keep the appropriate tension in the composite belt 1. Any small variance of the length of the composite belt 1 may be adjusted by the spring 32 automatically.

To increase the stability of the skateboard, the skateboard may adopt the tri-cycle design in FIG. 8. From FIG. 36 to FIG. 39 show the versatile design of the tri-cycle skateboard. The basic principle of the self-propelling wheels had been disclosed in the application Ser. No. 07/662,717, filed Mar. 1, 1991. FIG. 36 to FIG. 39 show the enhanced versions of the skateboard.

To be safe to operate, the pedal is especially designed for the self-propelling skate and skateboard. The pedal needs to have self-lock fast-release. In FIG. 36, the pedal 6 presses down and raises up the sliding rod 69. The sliding rod 69 drives the link 9 to rotate the crankshaft 90. The resilient pad 66 and the clamping washer 67 pivotally hold the truck 68. The link 71 connects the fork 68 to the board 40 with a universal joint 73 and a clamping resilient pad 72. The universal joint 73 is located at the edge of the board 40. The link 71 has the function of steering and shock absorbing. The restoring spring 691 is to help the raise of the pedal 6. Since the pedal 6 has the steering function and raising-up function and the pad 66 has the shock absorbing function, the restoring spring 691 and the link 71 are optional.

FIG. 37 is the alternative design of the self-propelling wheel. The link 79 is fixed to the truck 68. The link 79 passes through the ring of the rigid pole 77. The rigid pole is located on the central line along the board. The ring is at the bottom end of the rigid pole 77 and is clamped by the resilient pads 76.

FIG. 38 is the simplified version of FIG. 36. FIG. 39 is the simplified version of FIG. 37. The pedal 6 and the crank mechanism 90 are omitted. They function as the conventional skateboard.

In FIG. 40, the flange 61 is to hold the upper portion of the foot or heel. The rim 62 is to hold the shoe. As shown in FIG. 42, the rim 62 is in the shape of a horse-shoe. One arm of the rim 62 is at the upper position and one arm of the rim is at the lower position. As shown in FIG. 40 and FIG. 41, at the bottom of the upper arm, there are protrudes 621; at the top of the lower arm, there are protrudes 622. Under the pressing force of the bias spring 65, the protrudes 621 and 622 interlock with each other. The arm 62 is pivotally mounted on the stud 64. With the stud 64 as a pivot, the whole pedal 6 may swivel.

Figure 42A:
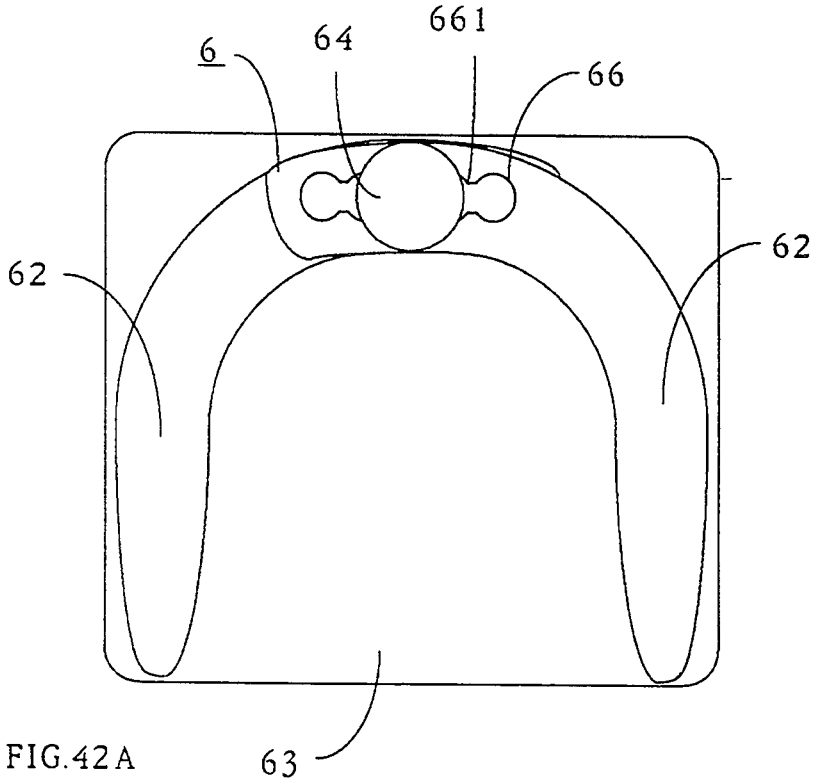
Figure 42B:
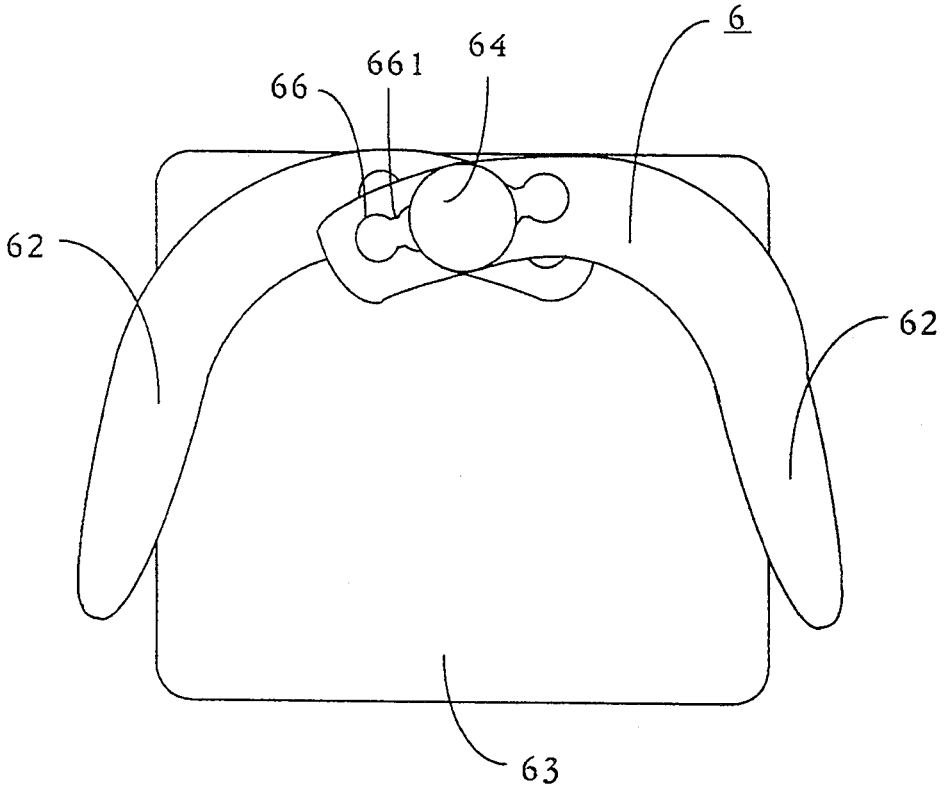

The operation of the pedal 6 is as shown in FIG. 42. In FIG. 42A, pulling out the shoe and applying force with the foot horizontally, the arms 62 are opened as shown in FIG. 42B. In FIG. 42B, kicking the center ends of the arms 62, the arms 62 swivel in and are self-locked as shown in FIG. 42A. As the shoe fits in the horse-shoe shape arm 62, the tip of the shoe or heel biases against the center ends of the rim 62. The arm cannot be opened at this position. It is in the self-locked mode.

To fit the different sizes of the shoe, the rim 62 can be adjusted. In FIG. 40, the upper segment of stud 64 is larger. It fits in the big holes 66 as shown in FIG. 42. The lower segment of the stud 64 is smaller. It fits in the slot 661 as shown in FIG. 42. To adjust the size of the pedal 6, swivel the rim 62 outside the pedal plate 63. Push the rim 62 downward that the lower segment of stud 64 can slide through the slot 661. As the arms 62 arrive the ideal position of the hole 66, release the pressing force. Under the biasing force of the spring 65, the arms 62 are pushed upward and self locked. Then swivel the pedal 6 back to the normal self-locked position.

Although the description above contains many specificities, these should not be construed as limiting the scope of the invention but as merely providing illustrations of some of the presently preferred embodiments of this invention. Thus the scope of the invention should be determined by the appended claims and their legal equivalent, rather than by the examples given.

I claim:

1. A skating apparatus comprising a plurality of wheels and a composite belt, said composite belt being flexible and compressible, said plurality of wheels being rotatably mounted on said skating apparatus in-line, a slot surrounding a peripheral of each of said plurality of wheels, said composite belt comprising a resilient belt and a plurality of beads, said resilient belt fitting inside said slot, said plurality of beads being embedded in said resilient belt, each of said beads comprising a bracket and a skating means, said bracket fitting with said slot and pressing against said resilient belt, said skating means being mounted on said bracket, said resilient belt serving to absorb shock, to adjust the height of belt to increase contacts with ground and to adjust track curvature of said composite belt in turning direction to turn left and right wherein said composite belt further comprising strings, said strings passing through said bracket of each of said beads to hook-up said beads to be a chain.

2. A skating apparatus according to claim 1, wherein said skating means of each of said beads constituting of V-shape knives, said V-shape knives being molded with said bracket as an integrated unit with an edge parallel to said resilient belt.

3. A skating apparatus according to claim 1, wherein said skating means comprises a plurality of rollers, each of said plurality of rollers being rotatably mounted on said bracket with an axle parallel to said resilient belt.

4. A skating apparatus according to claim 3, wherein said skating means further comprises a pair of knives, said pair of knives being parallel to the axle of said plurality of rollers, said knives being molded with said bracket as an integrated part of said bracket.

5. A skating apparatus according to claim 1, further comprising a frame and a constant tension means, said plurality of wheels being mounted on said frame, said constant tension means comprising a sliding guide, a pair of slots and a bias-ing means, said pair of slots being knotched on said frame, an axle of one of said plurality of wheels passing through said sliding guide to slide along said slots with said sliding guide, said biasing means biasing against said sliding guide to pull said axle of said wheel to keep a constant tension on said resilient belt.

6. A skating apparatus according to claim 5, wherein said biasing means comprising an adjusting screw and a spring means, said spring means being mounted on said adjusting screw to bias against said sliding guide to apply force to pull said axle or said wheel.

7. A skating apparatus according to claim 1, further comprising a self-propelling mechanism installed on one of said wheels, said self-propelling mechanism comprising a pedal, links and a crankshaft, said crankshaft being mounted on said wheel, said links making connection between said pedal and said crankshaft, an up and down movement of said pedal rotating said crankshaft to rotate said wheel to skate.

8. A skating apparatus according to claim 7, wherein said self-propelling mechanism further comprising an engaging drum, a hub and a gripping means, said crankshaft having screws knotched on it, said engaging drum being rotationally mounted on the screws of said crankshaft, said hub being rotationally mounted inside said wheel, said gripping means biasing between said frame and said engaging drum to grip said engaging drum with gripping force, said crankshaft driving said wheel to rotate with an engagement of said engaging drum and said hub.

9. A skating apparatus according to claim 1, further comprising a pair of wheels and a truck, said pair of wheels being rotatably mounted on said truck, said truck being mounted on said skating apparatus.

10. A skating apparatus according to claim 1, wherein each of said plurality of wheels is individually wrapped by one of said composite belt.

11. A skating apparatus according to claim 1, further comprising a board, said plurality of wheels being grouped into two sets of wheels, each set of wheels being rotatably mounted under said board in line and being enwrapped by one or said composite belt.

12. A skating apparatus according to claim 11, wherein said board comprises two segments, said two segments being connected with an adjusting screw means, by adjusting said adjusting screw means, said two segments being able to shift from in line aligment to off-line alignment;

by releasing said adjusting screw means, said skating apparatus being separated into two in-line roller skates.

13. A skating apparatus according to claim 12, wherein each of said segments further comprising a self-propelling means, said self-propelling means comprising a pedal and a plurality of links, said plurality of links making connection between said pedal and one of said wheels, an up-and-down motion of said pedal driving said plurality of links to rotate said wheel to skate.

14. A skating apparatus according to claim 9 further comprising a self-propelling mechanism for said pair of wheels, said self-propelling means comprising a pedal, a sliding link, a cranking link and a crankshaft, said sliding link making connection between said pedal and said cranking link, said cranking link being coupled to said crankshaft, an up-and-down motion of said pedal rotating said crankshaft to drive said pair of wheels to skate.

15. A skating apparatus according to claim 14, further comprising resilient pads and clamping washers for said pedal, said resilient pads clamping on said skating apparatus, said clamping washers clamping said resilient pads, said pedal passing through a hole of said clamping washers and said resilient pads.

16. A skating apparatus according to claim 14, wherein said self-propelling mechanism further comprises an engaging drum, a hub and a gripping means, said crankshaft having screws knotched on it, said engaging drum being rotatably mounted on the screws of said crankshaft;

said gripping means biasing between said frame and said engaging drum to grip said engaging drum, said crankshaft driving said pair of wheels to rotate with an engagement of said engaging drum and said hub.

17. A skating apparatus according to claim 13, wherein each of said pedal comprises a pad, two arms, a stud and a bias spring, said two arms being mounted on said pad with said stud, said bias spring being mounted on said stud;

said two arms being biased with said bias spring;

each of said two arms comprising a plurality of locking protrudes, under biasing force of said bias spring, said two arms being locked together.

18. A skating apparatus according to claim 17 wherein each of said two arms comprises a slot with a plurality of holes, said stud comprising two segments with different radius, a first segment having smaller radius fitting inside said slot, a second segment having larger radius fitting inside said holes, said spring biasing said arms toward the bigger segment of said stud.

19. A skating apparatus according to claim 9 further comprising a plurality of links, a universal joint and a plurality of clamping pads, said universal joint attached to a bottom of said board, said plurality of links having one end being coupled to said universal joint and another end being coupled to said clamping pads;

said clamping pads clamping an extension of said truck.

20. A skating apparatus according to claim 9 further comprising a pole, a steering rod and a clamping pad, said pole being fixed to a bottom side of said board, said steering rod being fixed to said truck;

said clamping pad being mounted on said steering rod to clamp said pole.

21. A skating apparatus comprising a frame, a self-propelling means and a skating means, said self-propelling means comprising a pedal, a plurality of links and a wheel, said wheel being mounted on said frame with an axle, an up-and-down motion of said pedal driving said plurality of links to rotate said wheel to skate, said skating means being mounted at the bottom of said frame, said self-propelling means further comprising an engaging drum, a hub and a gripping means, said crankshaft having screws knotched on it, said engaging drum being rotatably mounted on the screws of said crankshaft, said hub being rotatably mounted inside said wheel, said gripping means biasing between said frame and said engaginging drum to grip said engaging drum with gripping force, said crankshaft driving said wheel to rotate with an engagement of said engaging drum and said hub wherein said skating means further comprises a plurality of rollers, said rollers being rotatably mounted on said frame to provide transverse motion for said skating apparatus.

22. A skating apparatus comprising a constant tension mechanism, a frame, a plurality of wheels and a belt, said plurality of wheels being rotatably mounted on said frame, said belt surrounding said wheels;

said constant tension mechanism comprising an adjusting screw, a biasing spring and a sliding guide, a pair of holes knotched on said sliding guide;

a pair of sliding slots being knotched on said frame;

said plurality of wheels being mounted on a plurality of axles, one of said axles passing through said holes on said sliding guide and sliding inside said sliding slots:

said adjusting screw being threaded on said frame, said biasing spring mounted on said adjusting screw to bias against said sliding guide;

said biasing spring biasing against said sliding guide to maintain the constant tension in said belt; adjusting said adjusting screw to adjust said constant tension in said belt.

* * * * *

UNITED STATES PATENT AND TRADEMARK OFFICE

CERTIFICATE OF CORRECTION

PATENT NO. : 5,382,052

DATED : January 17, 1995

INVENTOR(S) : Min M. Tarng

It is certified that error appears in the above-indentified patent and that said Letters Patent is hereby corrected as shown below:

On title page, item [54] delete the word "BLADE" from the title.

also, delete "BLADE" from lines 1 and 3 of the abstract, and column 1, lines 9, 13, 25, 31 and 32.

Signed and Sealed this

Seventh Day of November, 1995

Bruce Lehman

*Attest:*

BRUCE LEHMAN

*Attesting Officer*

*Commissioner of Patents and Trademarks*